United States Patent [19]

McCain et al.

[11] 3,981,212

[45] Sept. 21, 1976

[54] SHEET TRIMMING MACHINE

[75] Inventors: William B. McCain, Hinsdale; James F. Cosgrove, Western Springs; Elmer D. Bewersdorf, Downers Grove, all of Ill.

[73] Assignee McCain Manufacturing Corporation, Chicago, Ill.

[22] Filed: Jan. 29, 1973

[21] Appl. No.: 327,488

Related U.S. Application Data

[62] Division of Ser. No. 115,174, Feb. 6, 1971, Pat. No. 3,732,766.

[52] U.S. Cl. ..... 83/155; 83/268; 83/404; 83/422; 83/424; 83/467 R; 83/925 A

[51] Int. Cl. ..... B26d 7/06; B26d 7/16

[58] Field of Search ..... 83/155, 154, 422, 424, 83/435.2, 467, 391, 268, 925 A, 404

[56] References Cited

UNITED STATES PATENTS

| | | | |
|---|---|---|---|
| 1,892,327 | 12/1932 | Buccicone et al. | 83/424 X |
| 2,482,685 | 9/1949 | Moyer | 83/925 A X |
| 3,146,650 | 9/1964 | Sarring et al. | 83/925 A X |
| 3,167,987 | 2/1965 | McCain | 83/925 A X |
| 3,499,355 | 3/1970 | Wiatt et al. | 83/424 X |
| 3,570,344 | 3/1971 | Bryson et al. | 83/155 |
| 3,575,076 | 4/1971 | Baldwin et al. | 83/424 X |

*Primary Examiner*—Frank T. Yost

*Attorney, Agent, or Firm*—Kinzer, Plyer, Darn & McEachran

[57] ABSTRACT

A three-knife sheet trimmer is so constructed as to separate the drive for the knives (one front knife and two side knives) from the drive for the clamps which hold the sheets (e.g., the sheets of a book) stationary while being trimmed. The knives at the stations are operated out of phase, and the moving masses are therefore balanced compared to the previous form of these trimmers where all knives move in the same direction at the same time. Separating the drives also enables a book to be sooner advanced from the first knife station to the second knife station. This being so, there is a greater allowance of time in which to make the transfer, and hence there is no need to rush the book.

The stops at the several knife stations against which a book is advanced may be adjusted simultaneously, and the separate feed means which advance or feed the books first from the first knife station to the second knife station and then out of the second knife station, may be opened or spread apart simultaneously either for re-adjustment to accommodate books of a different size or for the purpose of clearing a jam.

5 Claims, 38 Drawing Figures

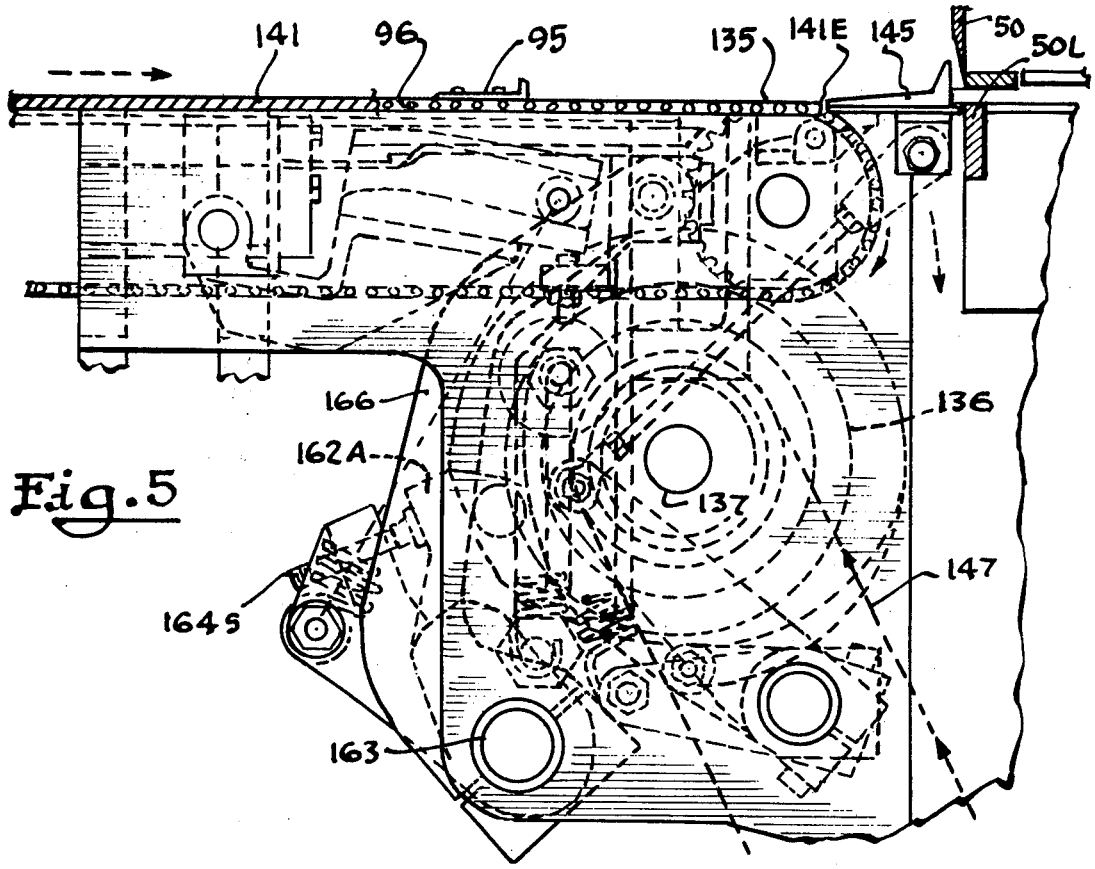
Fig. 5
Fig. 6
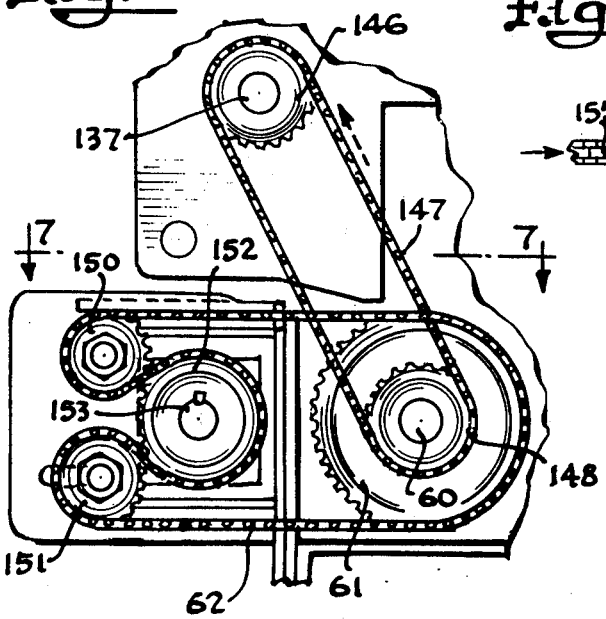
Fig. 7
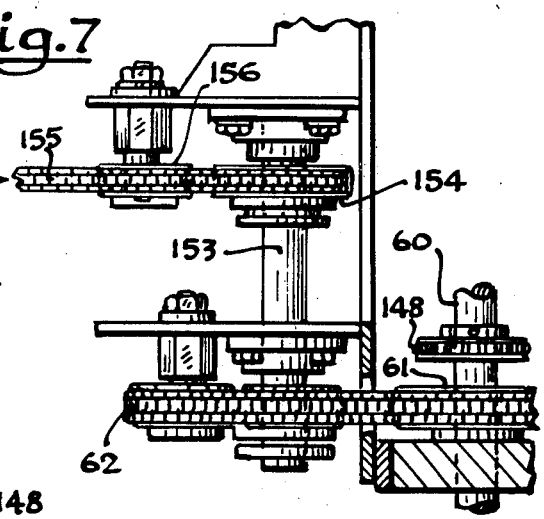

Fig. 24
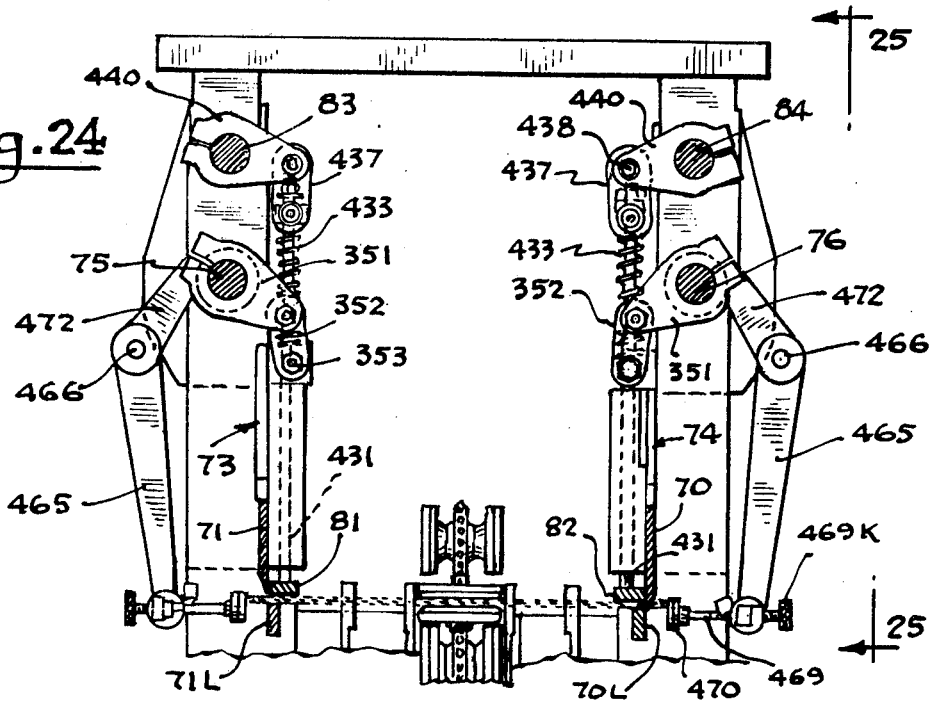
Fig. 25
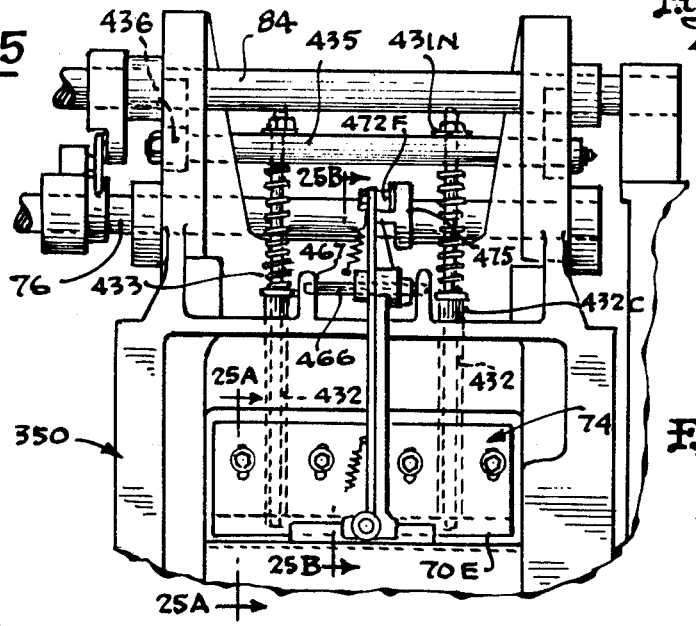
Fig. 25C
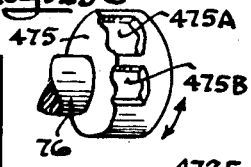
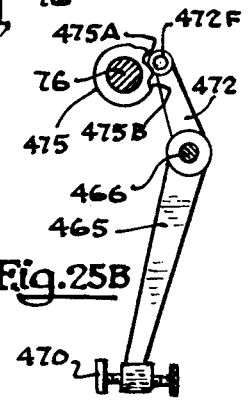
Fig. 25B
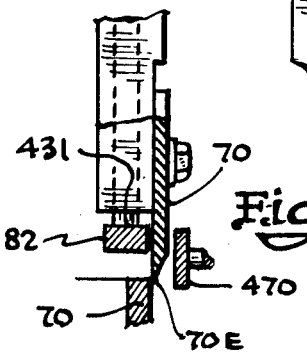
Fig. 25A Fig. 28
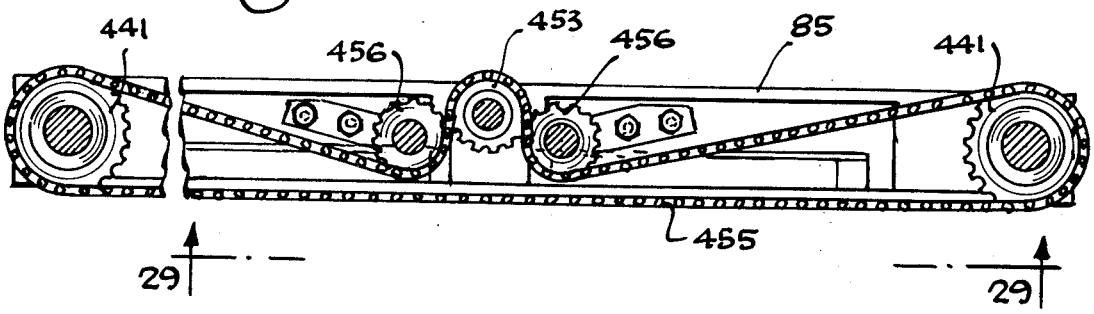
Fig. 29
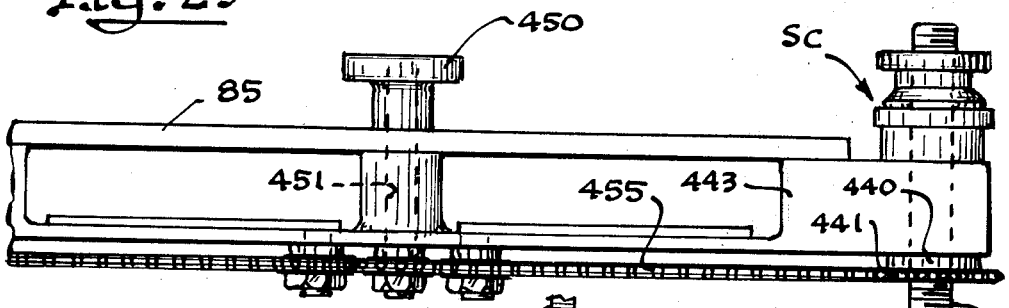
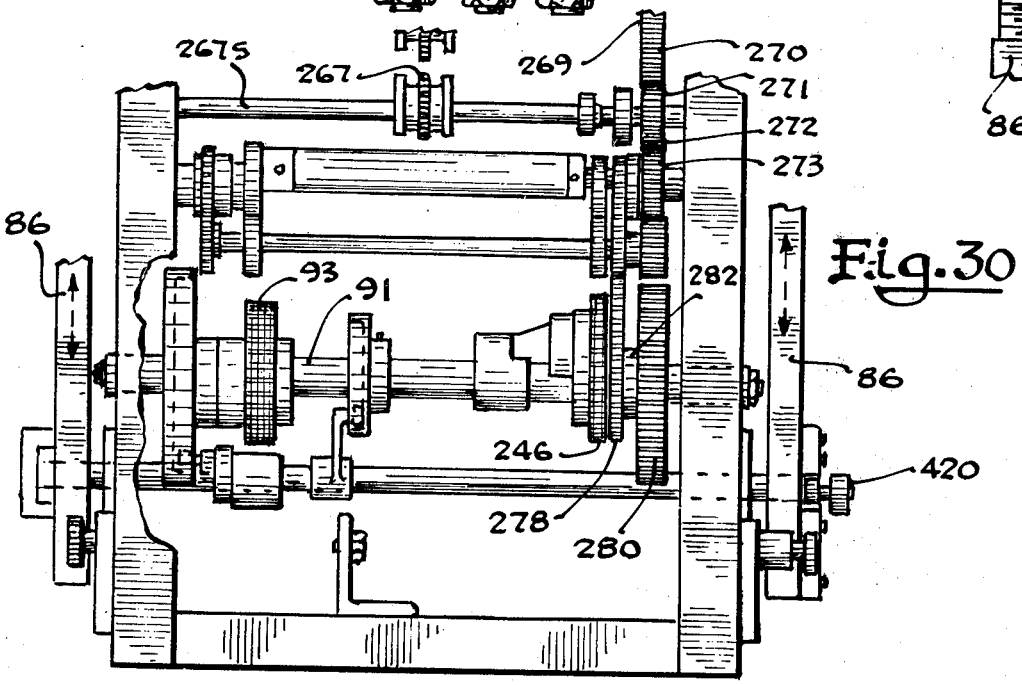
Fig. 30

SHEET TRIMMING MACHINE

This Application is a division of Application Ser. No. 115,174, filed Feb. 16, 1971, now U.S. Pat. No. 3,732,766.

This invention relates to a cyclically operable trimming machine in which stacked sheets such as signatures or the like are fed through the machine in successive cycles and have the edges thereof trimmed.

Signatures (folded sheets) which comprise books (e.g., magazines, newspaper supplements and the like) are collected into individual groups or stacks and are joined at their backbones (the fold) to complete the content of the individual books. The backbones of the signatures in the collected group may be joined by staples. After the signatures are gathered into groups, and the groups thus joined into books, it is customary to trim each book to accurate size by a front cut, which is a cut along the edges of the sheets parallel to the backbone, and a so-called head and foot cut at right angles to the front cut.

The machine employed for the trimming operation is usually designated as a three-knife trimmer, there being a knife of shearing form for making the front cut and a pair of similar shear-cut knives spaced from one another and cutting at right angles to the first knife for producing trims at the head and foot of the book. Each knife has a moving head presenting a cutting edge which cuts in opposition to a fixed knife edge therebeneath, and in the known machine the front knife head is effective to drive the side knives, but in a manner different from the way in which the front knife drives the side knives under the present invention.

In a three-knife trimmer as heretofore constructed the front knife has been effective in one cycle of the machine, whereafter the book is advanced to the second knife trimming station for head and foot trimming in the next cycle of the machine. In actual operation it has been necessary to accelerate the book very rapidly from the front knife trimming station to the side knife trimming station between successive cycles of the machine. This need for acceleration has been necessitated by the fact that the hold-down devices for clamping the book and holding it stationary at th front knife station are carried by the head of the front knife for movement therewith. Thus the three-knife trimmer as heretofore constructed is one where the book clamps are brought into engagement with the book at the front knife station as an incident to the downward cutting stroke of the front knife. Release of the clamps is a function of the return stroke of the knife. In fact the construction of the known machine is such that the front knife is clear of the book in the course of its return stroke for nearly one-fourth of a cycle before the clamps are freed from the book, and of course it is not possible to transfer the book to the second knife station in the meantime.

There can be no question about the efficiency and satisfactory operation of the three-knife trimmer which preceded the present invention, but an analysis reveals that by separating the drive for the book clamps from the drive for the trimming knives the book can be transferred from the first knife station to the second knife station at less speed whereby the tolerances for registering are enlarged (e.g., the book does not have as much momentum or "bounce" at the slower speed) and it is possible at the same time to operate the front on the one hand and the side knives on the other hand 180° out of phase thereby balancing knife motion. Thus, by separating the drives for the clamps and the knives we are able to transfer the book in an easier fashion and to minimize vibrations. The separation of the clamp drive and the knife drive to allow the foregoing advantages to be realized constitutes the primary object of the present invention.

In preparing for a run with any machine of the kind involved, a considerable amount of "make-ready" is involved in that all operating parts having functions related to the dimensions of the sheets must be adjusted to those dimensions. Such parts include stops and feed belts. Other objects of the present invention are to construct a three-knife trimmer so that make-ready time is materially diminished and to do this by enabling the stops at the two trimming stations to be adjusted simultaneously, and to enable the feed bands for transferring the sheets from one station to another to be adjusted simultaneously through a parallelogram link system.

In the drawings:

FIGS. 3, 4 and 5 are detail sectional views of the machine showing certain cams and related parts;

FIG. 6 is a detail view in elevation showing the manner in which an eccentric shaft and a cam shaft are driven;

FIG. 7 is a sectional view on line 7—7 of FIG. 6;

FIG. 24 is a detail sectional view showing the clamps and side joggers at the second trimming station;

FIG. 25 is a view on the line 25—25 of FIG. 24;

FIGS. 25A and 25B are detail sectional views on the lines 25A—25A and 25B—25B of FIG. 25;

FIG. 25C is a detail perspective of one of the jogger cams;

FIGS. 28 and 29 are, respectively, a detail side elevation and a plan view of the adjusting chain associated with the knife clamp, FIG. 29 being taken on the line 29-20 of FIG. 28;

FIG. 30 is a detail end elevation at the delivery end of the machine;

GENERAL DESCRIPTION

Figure 9:
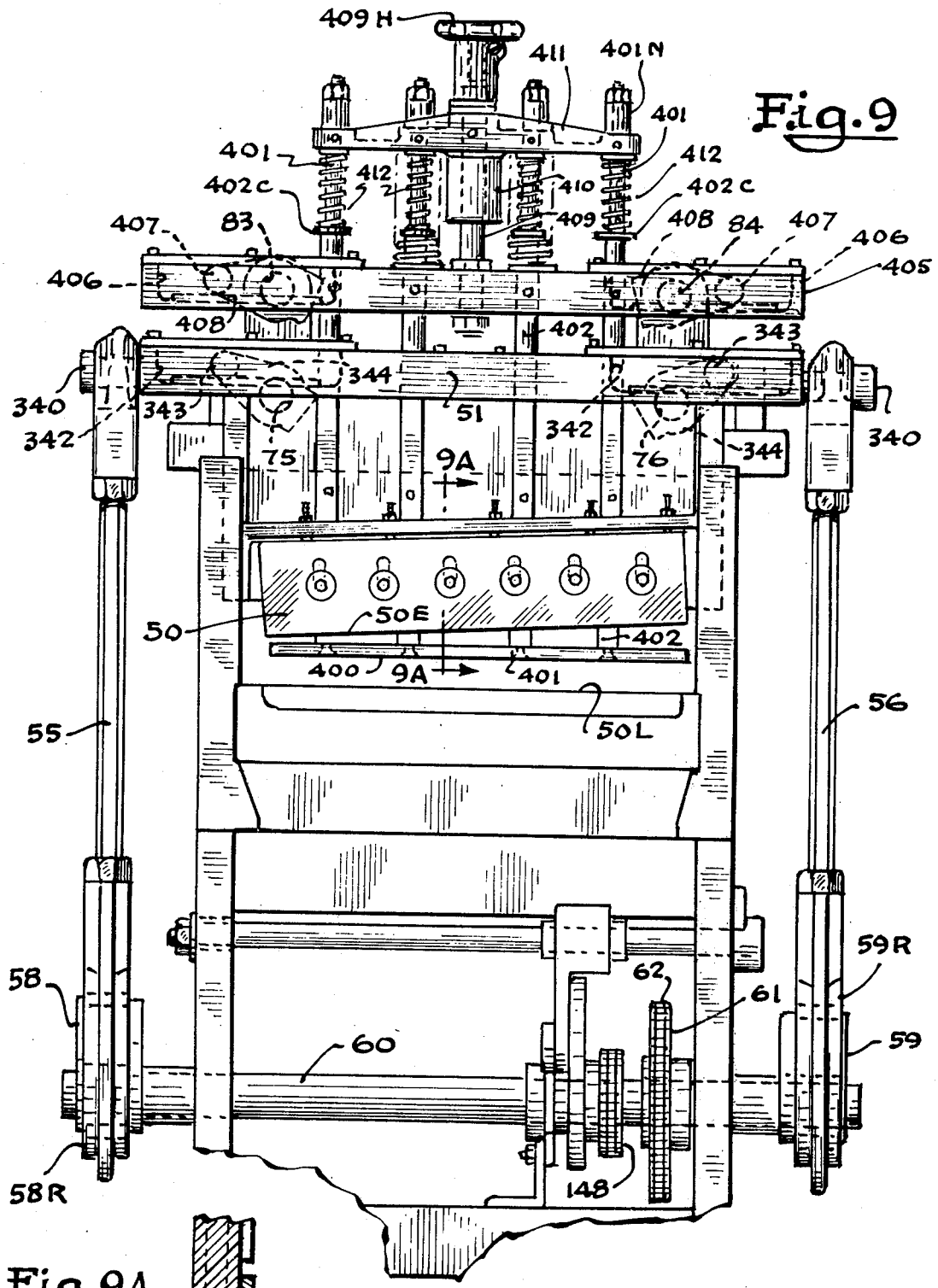
FIG. 9 is an end elevation at the front of the machine.
Figure 9A:
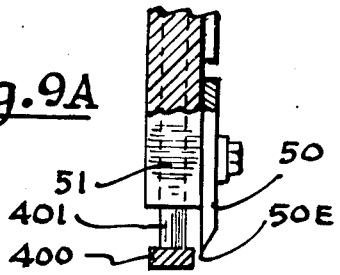
FIG. 9A is a detail sectional view of the front knife and front clamp.
Figure 31:
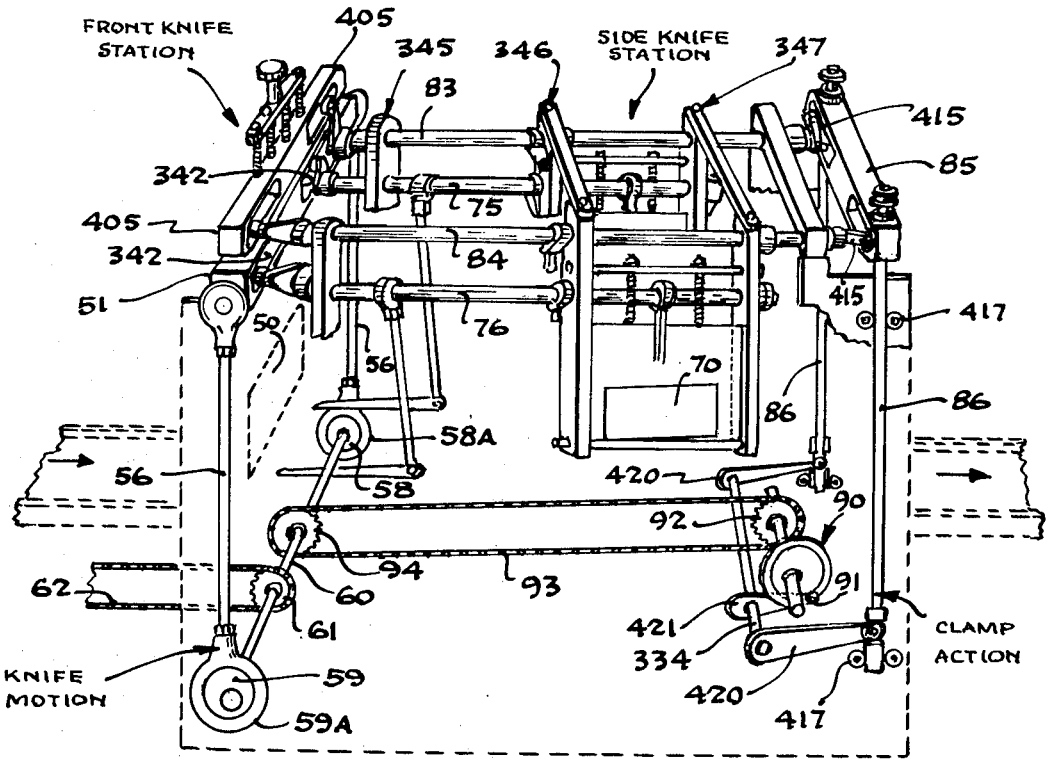
FIG. 31 is a perspective view of the machine somewhat schematized to simplify the understanding of the general arrangement and organization of the machine.

Referring to FIGS. 9 and 31, the front knife 50 of the machine at the front knife station, is carried by a massive head 51 which is reciprocated by a pair of rods 55 and 56 operated by eccentrics 58 and 59 themselves of sufficient mass to produce a fly-wheel effect. The eccentrics are fixed to an eccentric operating shaft 60 having a sprocket 61 keyed thereto and driven by a chain 62 to rotate the eccentrics. The cutting edge 50E, FIG. 9, of the first knife trims the sheets by shearing in opposition to a fixed lower edge 50L.

Referring to FIGS. 24 and 31, the reciprocal side knives 70 and 71 have cutting edges working in opposition to fixed lower edges 70L and 71L, FIG. 24, to trim the heads and feet of the sheets at the second or side knife station, FIG. 31. The side knives are each supported by a massive head 73 and 74, and as will be explained in more detail, motion of the front knife is transmitted through a pair of rock shafts 75 and 76 to operate the side knives in unison.

Referring to FIGS. 24, 25, and 25A, there is a front clamp 400 for clamping the front of the book adjacent the front margin while being trimmed at the front knife station, and a pair of side clamps 81 and 82 for clamping the sides of the book adjacent the head and footmargins while being trimmed by the side knives.

The clamps thus afforded at the two trimming stations have reciprocal motion imparted thereto by means including a pair of rock shafts 83 and 84, FIG. 31. These rock shafts in turn are oscillated by means to be described in more detail below including a reciprocating head 85 reciprocated vertically by a pair of rods 86 controlled by a box cam assembly 90. The box cam 90 is fixed to a cam shaft 91 having a sprocket 92 thereon, turned by a chain 93. The chain 93 in turn is driven by a sprocket 94 fixed to the eccentric drive shaft 60.

Figure 1:
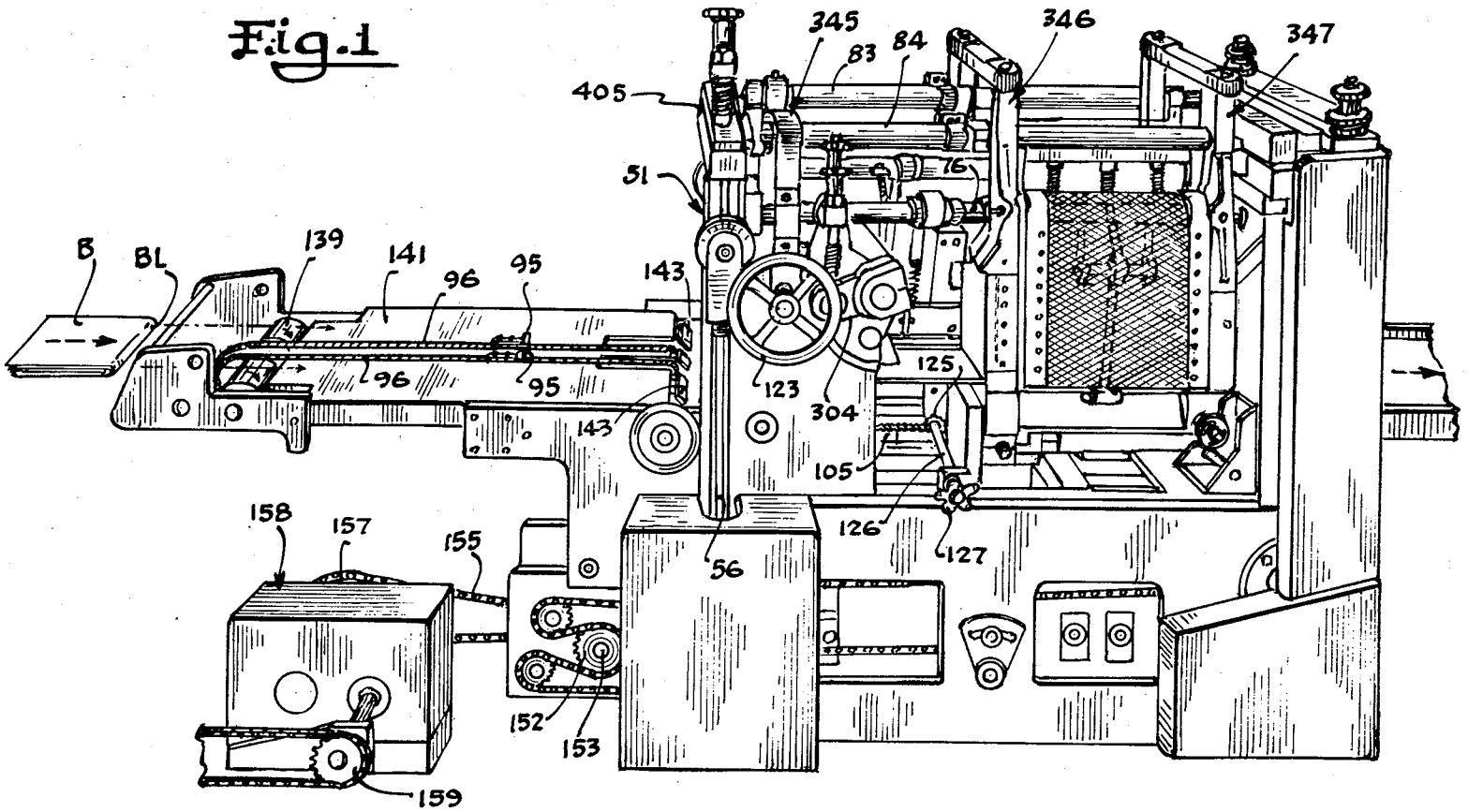
FIG. 1 is a perspective view of the three-knife trimming machine of the present invention.

The books or stacked sheets to be trimmed are advanced to the first trimming station by in-feed means in the form of lugs 95 projecting upwards from related in-feed chains 96, FIG. 1. Interposable stop means in the form of upwardly projecting fingers 100, FIG. 18, engage the backs of the sheets advanced to the front knife at the proper time, accurately to position the sheets for the front edge trim, following which the sheets are fed forward to a second stop 101 of similar form and function for accurately registering the books for trimming at the second station.

The stops 100 and 101, while independently related functionally to the front knife station and the side knife station, are supported in such a fashion that both can be adjusted simultaneously through a rack 105 to accommodate the stops to sheets of different length.

The book or group of stacked sheets subjected to front knife trimming is transferred to the side knife station by means including resilient transfer lugs, there being an upper set of such lugs 110 and a lower set 111, FIG. 18, respectively carried on a pair of upper feed bands 112 and a pair of lower feed bands 113 in the form of endless chains as will be described in more detail below. The feed lugs 110 and 111 at the proper time, following the front trim, engage the upper and lower side of the stack to transfer the stack to the stop 101. In like manner, there are upper and lower transfer lugs 116 and 117 at the side knife station supported on carrier chains 118 and 119, and these are effective to deliver the book or stack from the second knife station following head and foot trimming.

In order rapidly and efficiently to clear a jam at the front knife station or the side knife station and to be able quickly to adjust the carrier chains thus described to accommodate a book of different thickness, the supports for the upper carrier chains 112 and 118 are joined in a parallelogram linkage as will be described in more detail below so that the support system may be readjusted through a gear segment 120, FIG. 16, positioned by a pinion 121 fixed to a shaft 122 adapted to be rotated by a wheel 123 accessible at the side of the machine as shown in FIG. 1. It will also be noted in FIG. 1 that the track 105 is engaged by a pinion 125 carried on a shaft 126 which may be rotated by a handle or knob 127 available at the side of the machine.

DELIVERY OF BOOKS TO THE FIRST KNIFE STATION

While the machine in this instance is specifically concerned with trimming operations performed on books such as magazines or the like, herein identified by reference character B, it will be appreciated that a book is but one example of a stack of sheets which may be trimmed by the present machine, so the term "book" is inclusive and not necessarily exclusive.

Figure 8:
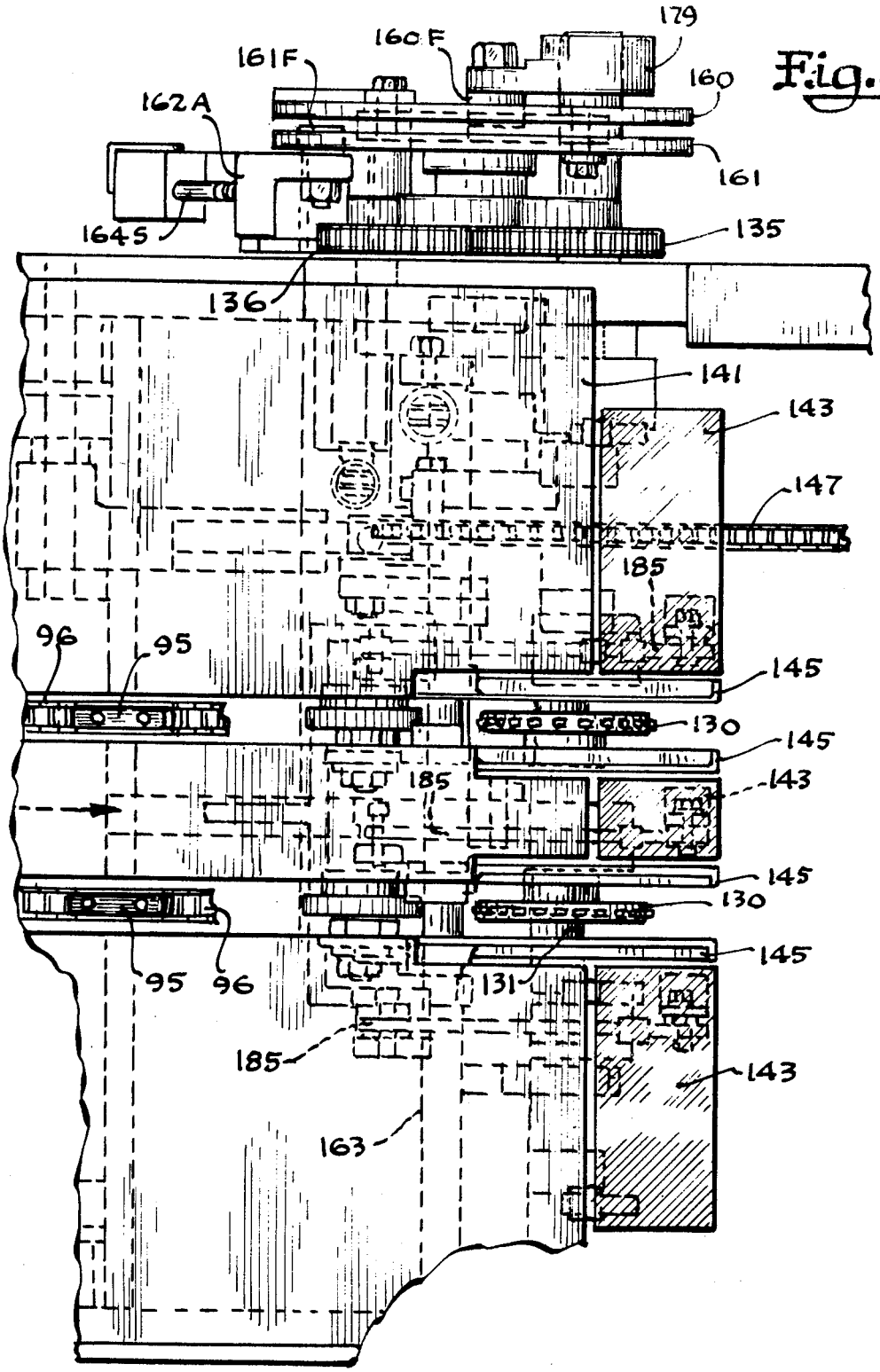
FIG. 8 is a fragmentary view on an enlarged scale showing a portion of the in-feed mechanism.

Each book to be trimmed is in-fed or advanced toward the front knife trimmer by the in-feed lugs 95, carried by in-feed chains 96 which are laterally spaced. The in-feed chains 96, FIG. 8, are turned by sprockets 130 carried on a sprocket drive shaft 131 turned by a driven gear 135 in an outboard position on the left side of the machine, FIG. 2A. The gear 135 in turn is driven by an outboard gear 136, FIGS. 2A, 5 and 8. Gear 136 is carried on the cam shaft 137, FIG. 5.

The chains 96 are constantly driven and the lugs 95 thereon are effective to advance the books toward the front trim knife. The books may be presented to the lugs 95 by rollers 139, FIG. 1, in such a fashion that a book is deposited on the chains 96 in advance of the arrival of a set of lugs, with the backbone BL in leading position, FIG. 1. The books may be arriving from a stitching machine where the signatures were joined to afford the book.

The in-feed lugs 95 move forwardly to the right as viewed in FIG. 1 along a plate or table 141. The inner end 141E of the table 141, FIG. 5, terminates short of the lower knife edge 50L associated with the front knife in order to allow room for the lugs 95 to make the necessary down turn, downward around the sprockets 130 for return travel as will be apparent on reference to FIGS. 8 and 1. This necessarily leaves a gap, reference character G, FIG. 3, between the front edge of plate 141 and the adjacent table or plate 142 associated with the front knife and which supports the book during the front trim. This gap is normally spanned by a trap door 143 in elevated position, FIG. 4.

Figure 3:
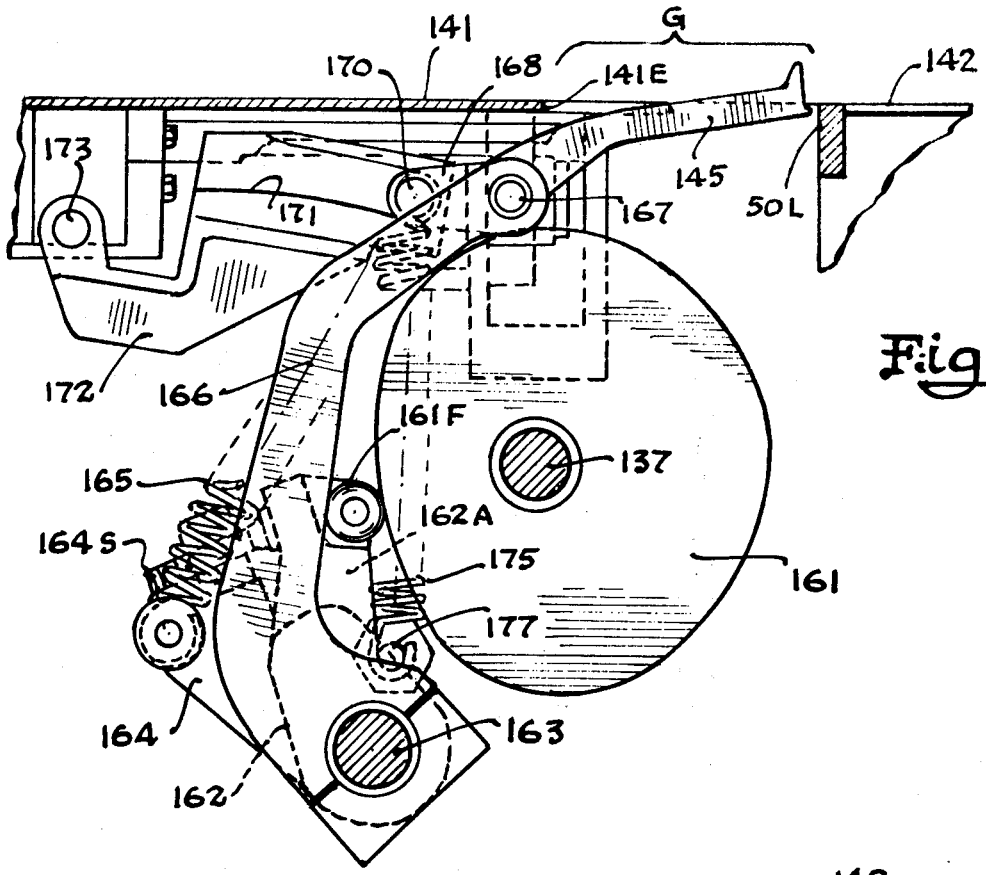

Four feed fingers 145, FIGS. 3, 5 and 8, are effective to advance the book up against the front stops 100, which is to say that as the in-feed lugs disappear beneath the top of the plate 141 the feed fingers 145 come forward to take over in a manner that will now be explained.

The cam shaft 137 extends laterally of the machine forward of the front knife station. This cam shaft has a sprocket 146 turned by a chain 147, FIG. 6, and the chain 147 in turn is driven by a sprocket 148 carried on the eccentric drive shaft 60. As shown in FIG. 6, the sprocket 61 for turning shaft 60 is driven by the chain 62 described above, and the chain 62 is trained around two tensioning idler sprockets 150 and 151, the chain 62 being driven by a sprocket 152 carried on a sprocket drive shaft 153. Referring to FIG. 7, the drive shaft 153 carries a sprocket 154, and this sprocket is driven by a chain 155 having a tensioning idler 156. The chain 155 in turn is driven by a large drive sprocket 157, FIG. 1, on a shaft (not shown) which is part of a gear box 158, and the input to the gear box 160 is in the form of a chain and sprocket drive 159 deriving constant motion from a motor, not shown.

Figure 2:
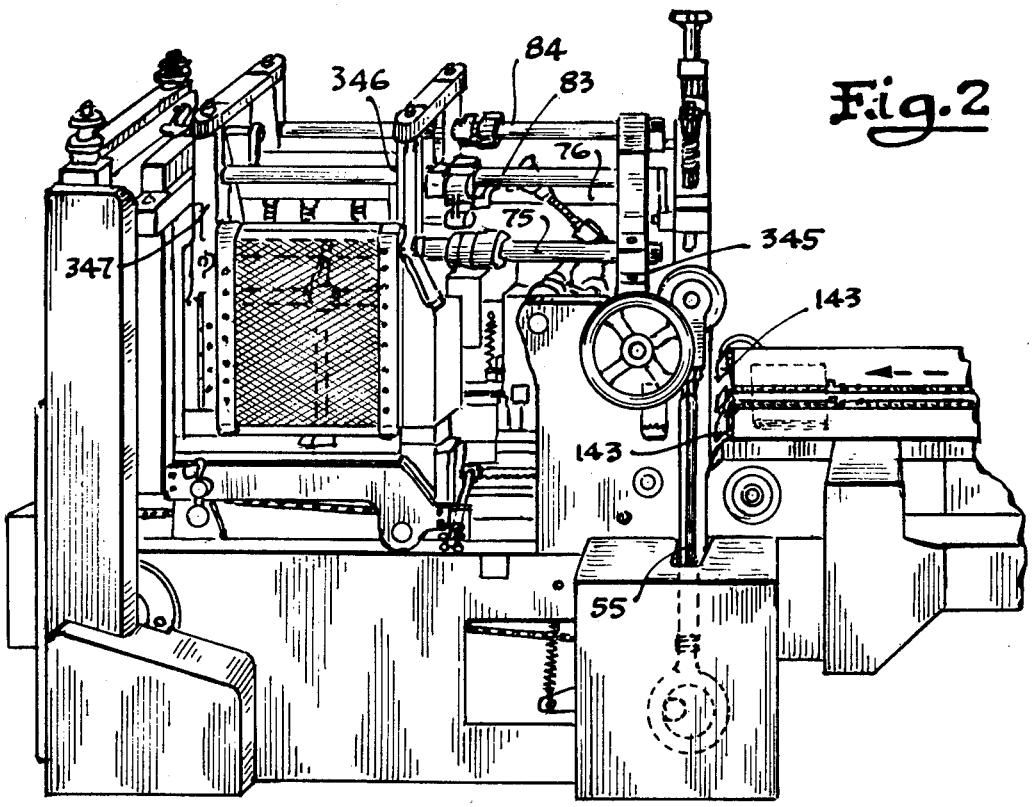
FIG. 2 is a reciprocated perspective view of the machine on the side opposite that shown in FIG. 1.
Figure 2A:
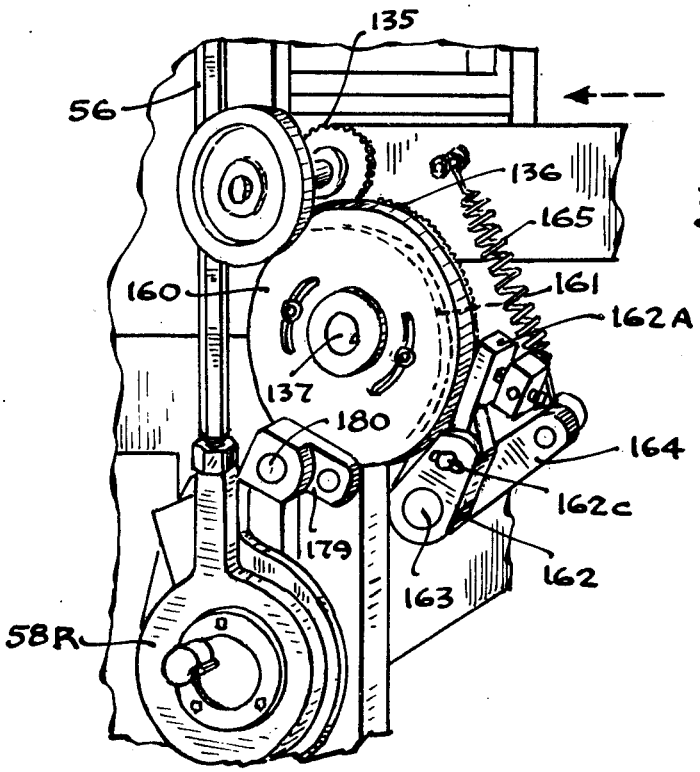
FIG. 2A is a detail perspective view showing an eccentric and a cam and related parts of the machine.
Figure 4:
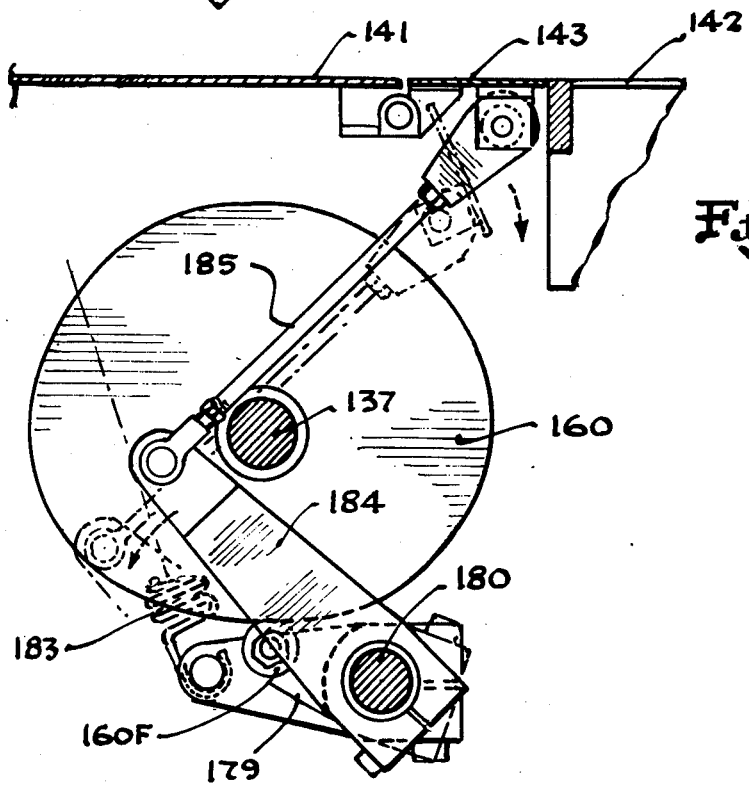

Referring to FIG. 8, the cam shaft 137 carries two relatively large cams 160 and 161 which are located in an outboard position on the left hand side of the machine, as will be more apparent in FIG. 2A. The outer one of these two cams 160, FIGS. 8 and 4, is adapted to raise and lower the trap door 143 and the inner one of the cams 161, FIG. 2, controls the pusher fingers 145. Cam 161 for operating the pusher fingers will first be described.

As shown in FIG. 3, a cam follower 161F is located on the rear side of cam 161 and is supported on an arm 162 as best shown in FIG. 2A. Arm 162 is secured to a rock shaft 163, and this same rock shaft has another arm 164 fixed thereto so that the assembly in effect is a bell crank. A spring 165 is tensioned between the free end of arm 164 and a stud at the side of the machine as shown in FIG. 2A, whereby the cam follower 161F is urged against its cam 160. The "zero" position of shaft 163 may be varied as will be described.

Rock shaft 163, FIGS. 3 and 5, extends parallel to the cam shaft 137 beneath the plate 141, and a large push finger operating arm 166, FIG. 3, is fixed thereto extending upwardly therefrom. Arm 166 pivotally supports a rock shaft 167 on which the four pusher fingers 145 are located.

A relatively short control arm 168, FIG. 3, is secured at its forward end to the rock shaft 167, and at the opposite end, arm 168 is provided with a roller 170 which travels in an arcuate guide slot 171. The guide slot 171 is formed in a bracket 172 which is positioned for adjustment on a pin 173 projecting from a support beneath plate 141. The bracket 172 is spring biased against an adjustable stop (not shown).

A coil spring 175 is tensioned at one end on a pin (not shown) projecting from arm 168, and the opposite end of the spring 175 is hooked to a stud 177 fixed to the machine. Thus it will be seen that the spring 175 acting on arm 168 serves at the same time to urge the rock shaft 167 counterclockwise as viewed in FIG. 3, thereby biasing the roller 170 to follow the slot 171.

In FIG. 3 the cam follower 161F is on the dwell or low part of the cam 161. The pusher fingers 145 are in a forward or extended position engaged with the trailing edge of the book, having pushed the book forward against the stops 100 at the front knife station. At this time, the roller 170 is located at the lower part, the forward end, of the guide slot 171. As cam 161 turns to present its lobe or high part to the follower 161F, rock shaft 163 which carries the push finger operating arm 166 is turned counterclockwise, thereby retracting fingers 145 leftward as viewed in FIG. 3, and at the same time the fingers 145 are depressed or moved downward due to clockwise turning movement of shaft 167 effected by the roller 170 moving leftward along the rising portion of the slot 171. When the dwell of the cam is presented, arm 166 carries the fingers 145 forward once more. It will be appreciated that this to-and-fro motion of the pusher fingers 145 is a cyclical operation controlled entirely by the cam 161. It should be stressed that the fingers 145 are moved forward to further in-feed the book at the time when the in-feed lugs 95 turn downward at the end of their forward flight.

Motion of the trap door 143 is under control of cam 160 which is also on cam shaft 137, FIGS. 3 and 4. The cam 160 has a follower 160F associated therewith. The follower 160F is carried on one end of an arm 179 fixed to a rock shaft 180. The rock shaft 180 has another arm 181 fixed thereto, and this arm is tensioned by a spring 183. Thus the spring 183 in effect tends to turn rock shaft clockwise as viewed in FIG. 4, holding the follower 160F against the periphery of cam 160. A trap door control arm 184 is fixed to the rock shaft 180 and extends rearwardly and upwardly therefrom.

In the condition illustrated in FIG. 4, the dwell of cam 160 is presented to the follower 160F. The trap door is elevated. At the time of the cutting stroke of the front knife, however, the rise or high part of cam 160 is presented to the follower 160F turning rock shaft 180 counterclockwise as viewed in FIG. 4. The control arm 184 is rocked rearward, withdrawing a link 185 which at one end is pivotally connected to the free end of arm 184 and which at the opposite end is pivotally connected to the underside of the door 143. It may be mentioned that the trap door is represented by three distinct and separate plates 143, FIG. 8, each having its own operating link 185. In like manner, there are three operating arms 184.

It will be seen from the foregoing that the sheets in a stack to be trimmed are moved against the registering stops 100 by the reciprocating pusher fingers 145 which engage the trailing edge of the book as the in-feed lugs 95 disappear beneath the top of plate 141. Thus the pushers 145 continue the in-feed, and when a book has been advanced against the stops 100 then the pusher fingers are retracted or withdrawn rearwardly and at the same time are lowered.

The trap door 143 is raised and lowered under cam control just as the reciprocal advancing and retracting movement of the pusher fingers is under cam control. The trap door elements 143 are in their lowered position at the time the front knife completes its cut.

The manner in which the book is registered for the front cut will now be described in more detail.

Figure 18:
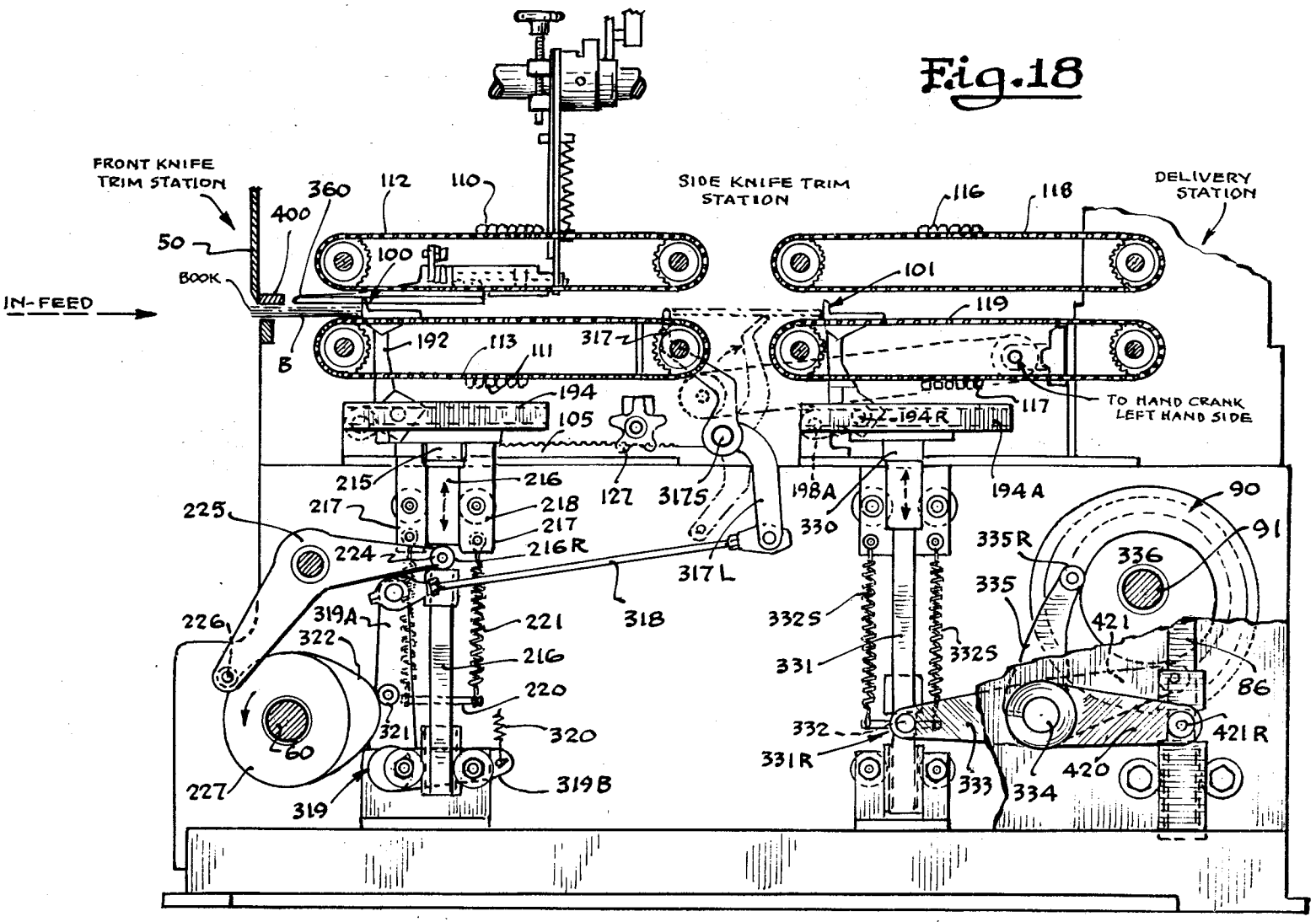
FIG. 18 is a sectional view of the machine showing in particular the way in which the stops are operated.
Figure 19:
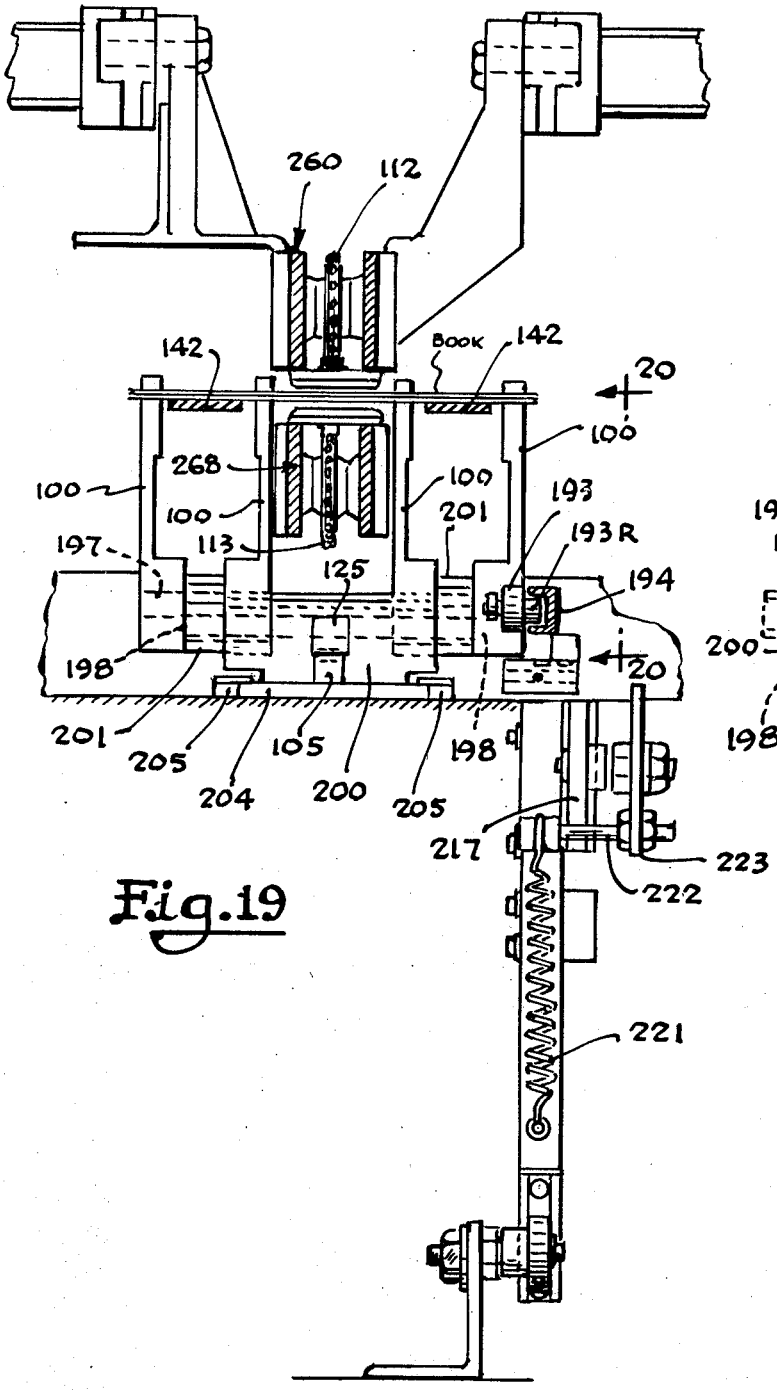
FIG. 19 is a sectional view of the machine also showing aspects of the stop operating mechanism and the supports for the feed bands.

There are four front stop assemblies 100, FIG. 19, laterally spaced from one another to engage the backbone of the book B, FIGS. 18 and 19. These stops are positioned to operate vertically in slots in the plate 142, FIGS. 3, 4 and 19, thereby to be interposed in and withdrawn from the path of the book moving to and from the front knife station.

Figure 20:
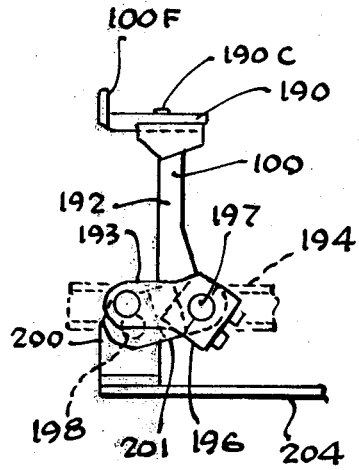
FIG. 20 is a detail view of a stop.

As shown in FIG. 20, each stop assembly 100 includes a vertically oriented finger 100F projecting upward at one end of a horizontal support 190. It is this finger which stops the book. The support 190 in turn is fastened at the upper end of a carrier arm 192 by a screw 190C extended through an elongated slot in the support which allows for fine adjustment to be made as to the precise position of the stop finger 100F.

The right hand support arm 192, FIGS. 19 and 20, has a rearwardly projecting extension 193 to which a roller 193R is journalled. The roller fits in the slot of a guide rail 194 which is responsible for raising and retracting the four stop fingers in unison in a manner to be described.

Each support arm 192 is formed with a forwardly projecting split clamp 196 which is clamped to a bail or shaft 197 which extends laterally. In this manner, the stops are joined by the bail 197 for operation in unison.

A support shaft 198 extends laterally, parallel to shaft 197 and rearward thereof. This shaft is journalled in an adjustment bracket 200. The ends of the shaft project outward of the bracket 200 and serve to pivotally support a pair of arms 201 which at their opposite or forward ends are fitted to the bail 197.

In effect, shaft 198 supports the two forwardly extending arms 201, the latter support the bail 197, and the bail joins the front stop support arms 192. The assembly of shafts and arms is secured against displacement by the clamps 196.

Figure 21:
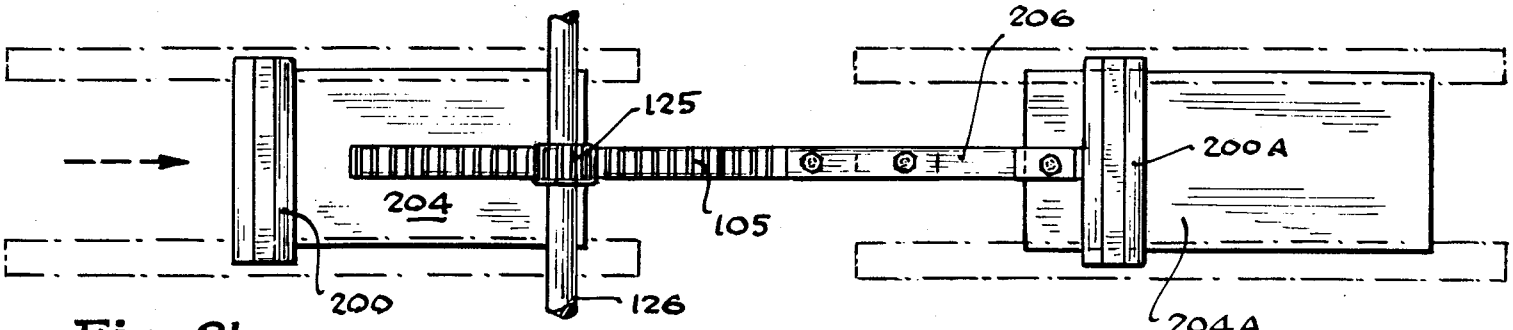
FIGS. 21, 22 and 23 are, respectively, a plan, a side elevation and an end elevation of the adjusting mechanism for the stops.

Before describing in detail the manner in which the stops 100 are interposed and retracted with respect to the book, it is appropriate to disclose the manner in which the front stops 100, FIG. 18, are connected to the rear stops 101 so that the two stops assemblies may be adjusted longitudinally in unison. Referring to FIG. 21, the bracket 200 supporting shaft 198 for the front stops is secured to a slide plate 204 which, as shown in FIG. 19, is adapted to slide in a guide afforded by laterally spaced flange-ways 205.

Figure 22:
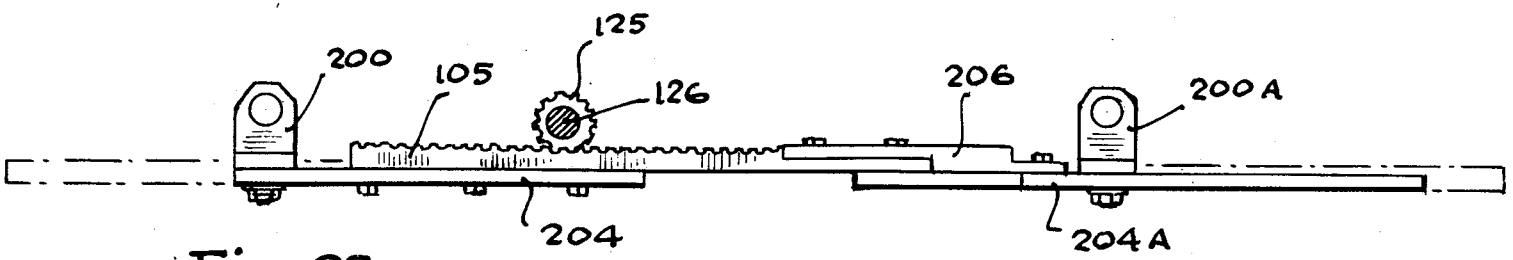
Figure 23:
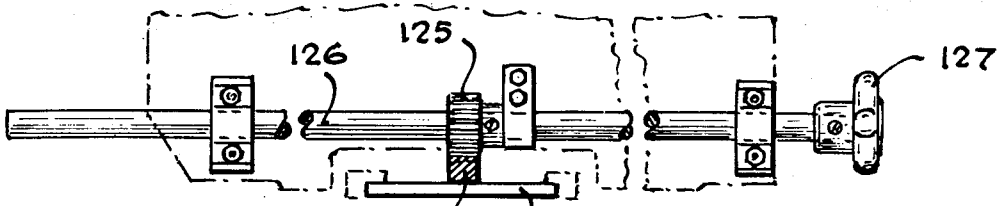

The slide plate 204 carried the adjustment rack 105, and the right-hand end of this rack 105 as viewed in FIG. 22 is fastened to a bracket 206 which in turn is fastened to a slide plate 204A which supports a bracket 200A identical to the bracket 200. The bracket 200A is associated with the rear stops in a manner quite similar to the bracket 200 for the front stops. Thus, when pinion 125, FIGS. 21–23, is turned, both slides 204 and 204A are shifted to alter the fore-aft position of the brackets 200 and 200A which support the front and rear stop assemblies. Since the brackets move, the front stop shaft 198 moves and so does the rear stop shaft 198A, FIG. 18, for the rear stop assemblies 101. The roller 193R merely moves on the rail 194, being carried along, noting that there is a rear rail 194A, FIG. 18, supporting a roller 194R which operates similar to the roller 193R in all respects as will now be described.

The rail 194 is secured to the upper side of a pedestal 215, FIG. 18, carried on a slide 216. The slide 216 is guided for vertical movement between a pair of fixed bars 217. Each bar supports an anti-friction roller 218 engaged with one side of the slide 216. The lower end of the slide is similarly guided.

A horizontal pin 220 is inserted in the slide and springs 221 at their lower ends are hooked to the pin 220 and at their upper ends are tensioned on studs 222, FIG. 19, secured to a plate 223 fastened to the guide bars 217. In this manner, the rail 194 is biased upwards to normally interpose the stop assemblies 100 in the path of the book.

Rail 194A which operates the rear stop assemblies 101 is similarly supported, guided and biased as shown in FIG. 18.

The slide 216 is cam controlled to retract the rail and support arms for the stops. Thus, the slide is provided with means defining a recess 216R intermediate its ends. A roller 224 is carried at the forward end of one arm of a bell crank lever 225, pivotally supported as shown in FIG. 18. The other arm of the bell crank carries a cam follower 226 associated with an operating cam 227 turned by cam shaft 60. Springs 221 hold the follower on the cam.

When the high part of cam 227 is presented to follower 226, the bell crank is rocked clockwise, FIG. 18, forcing slide 216 downward. Rail 194 is pulled downward and is effective on roller 193, FIG. 20 to withdraw the stops.

The effective operating angle of the rock shaft 163, and therefore the length of stroke of the pusher fingers 145, may be selected and adjusted through a set screw 164S, FIG. 3, threadedly mounted in arm 164. To this end, follower 161F is carried on a finger 172A, FIG. 2A, adjustable on arm 162 through a screw and slot connection thereto, shown by reference character 162C. The free end of screw 164S, FIGS. 3 and 5, bears on an abutment on the rear side of finger 162A. By adjusting the set screw and concurrently loosening 162C, the zero or index position of rock shaft 163 may be preset thereby to determine the effective stroke of the pusher fingers 145.

DELIVERY OF BOOKS TO AND FROM THE SECOND KNIFE STATION

As noted above, the carrier chains 112 and 113, FIG. 13, are provided with a plurality of soft, resilient carrier bars 110 and 111, and these are effective, following the front trim, to advance the partially trimmed book B toward the back or rear stop elements 101. Following head and foot trimming by the side knives, the back stops 101 are lowered, the trimmed book is picked up by similar carrier bars 116 and 117 on the carrier chains 118 and 119, and the completely trimmed book is advanced in the direction of a guide plate 230, FIG. 15, which guides the trimmed book to a delivery belt 231.

Figure 14:
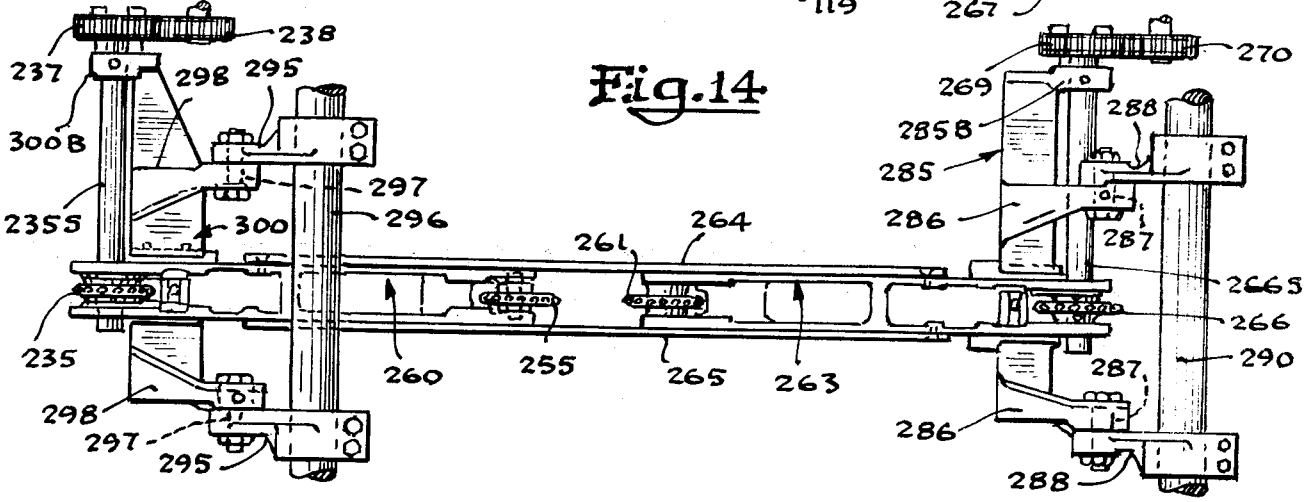
FIG. 14 is a top plan view of the supports and drives for the upper feed belts or carriers.
Figure 15:
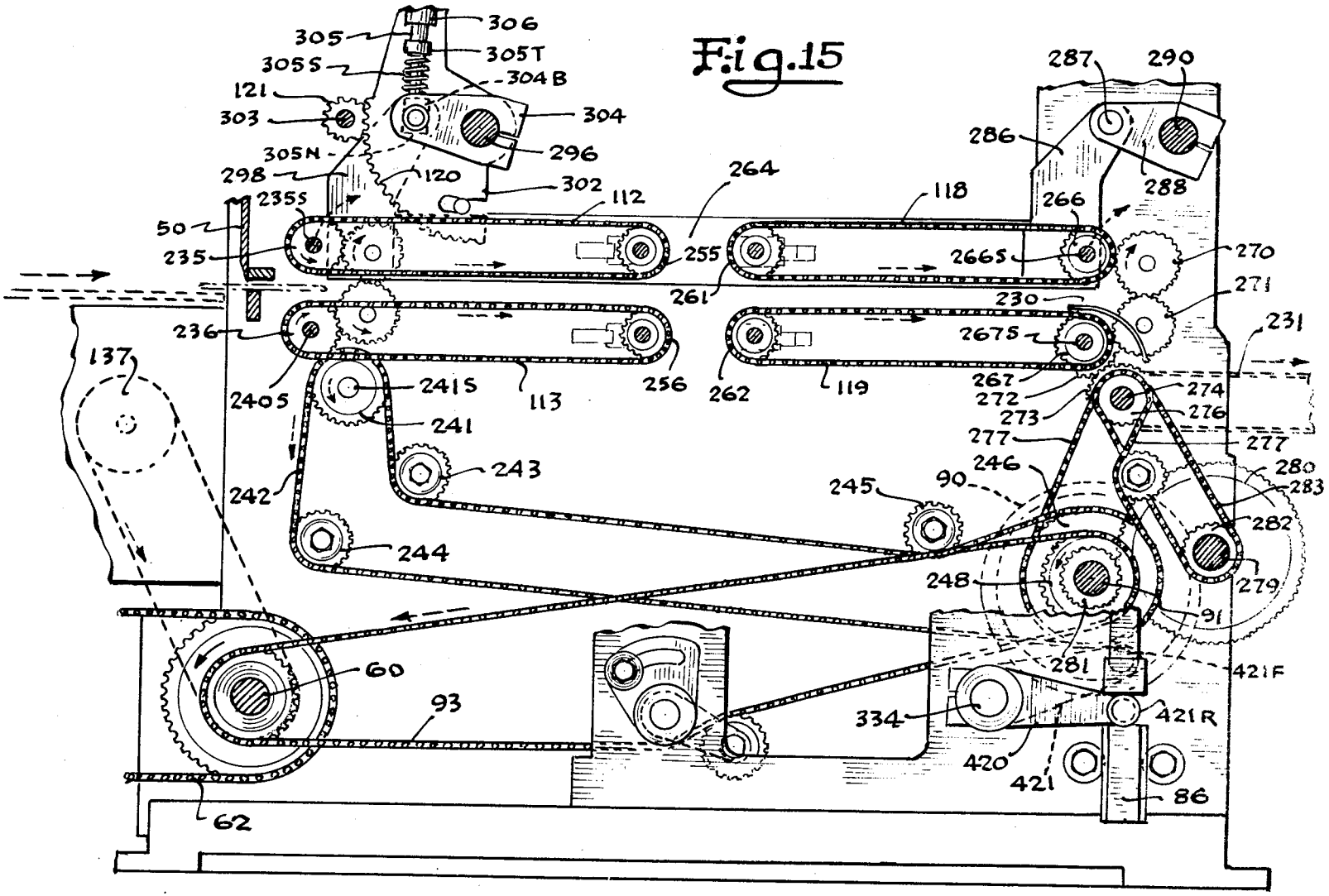
FIG. 15 is a fragmentary sectional view of the machine showing the manner in which many parts are driven.

The forward carrier chains 112 and 113 are respectively driven by driving sprockets 235 and 236, FIG. 15, one above the other. Referring to FIG. 14, sprocket 235, shown in plan view, is carried on a shaft 235S and the outboard end of this shaft is provided with a driven gear 237 meshed with a drive gear 238. Gear 238, FIG. 16, is meshed with a transmitting gear 239 in turn driven by gear 240 on a shaft 240S which supports sprocket 236, FIGS. 15 and 16A. The gears 238 and 239 are part of the train which includes 237–238–239–240, and are journalled on stud shafts supported by the side plate (not shown) of the machine. Gear 240 is meshed with and driven by a gear (not shown) journalled on a similarly supported stub shaft 241S, FIG. 15, which carries a sprocket 241 driven by a chain 242. The chain 242 is tensioned by idlers 243, 244 and 245 and is driven by a sprocket 246 on cam shaft 91. The cam shaft 91 supports a sprocket 248 driven by chain 93.

The carrier chains 112 and 113 are trained around rear sprockets 255 and 256, FIG. 15, which are idler sprockets. As shown in FIG. 14 the front and rear sprockets 235 and 255 (and in like manner the sprockets 236 and 256) are journalled at the opposite ends of support arms as 260.

In like manner, the rear carrier chains 118 and 119 are trained around idler sprockets 261 and 262, one above another, each journalled at the front end of a support arm as 263, FIG. 14. The support arms as 263, FIG. 14, support driving sprockets 266 and 267 at their opposite or rear ends, FIG. 15, around which the respective carrier chains 118 and 119 are trained. The support arms as 260 and 263 which support the carrier chain sprockets are joined by plates 264 and 265, FIG. 14.

Figure 16:
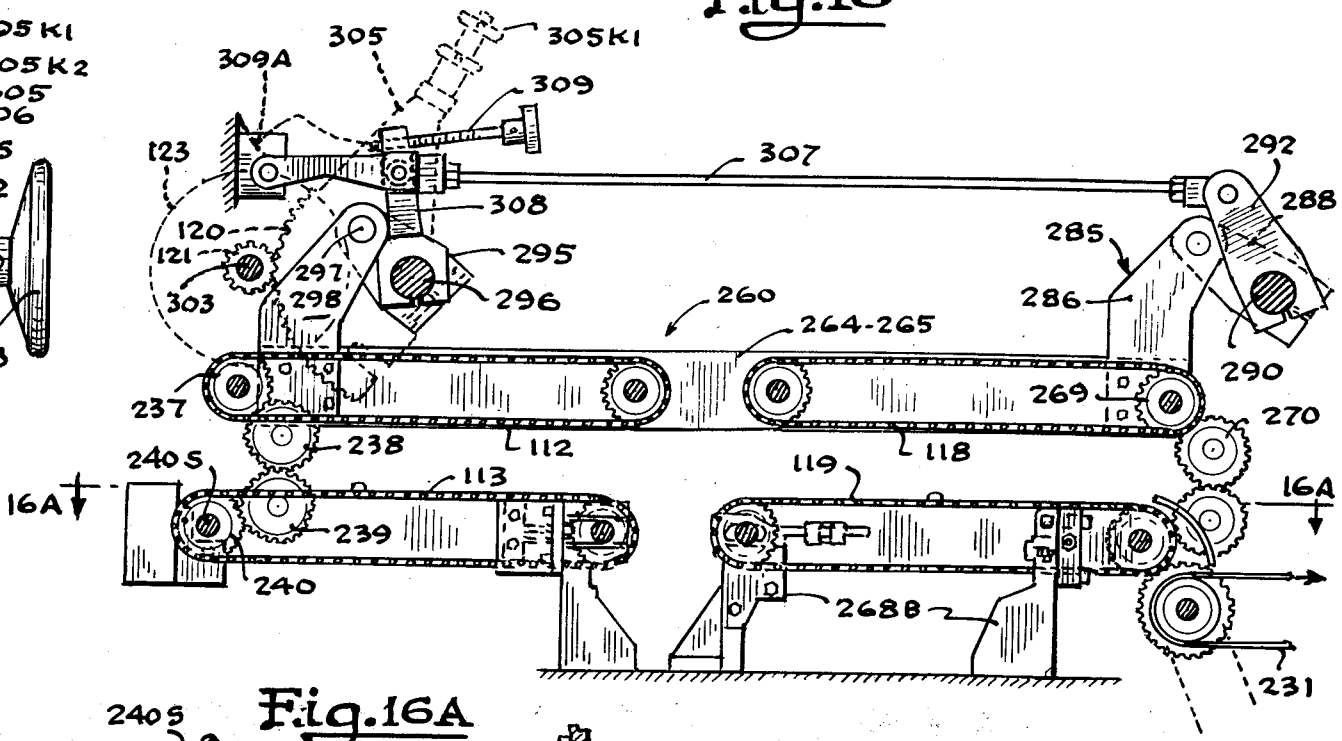
FIG. 16 is a detail sectional view of the means for adjusting the upper feed belt carriers.
Figure 16A:
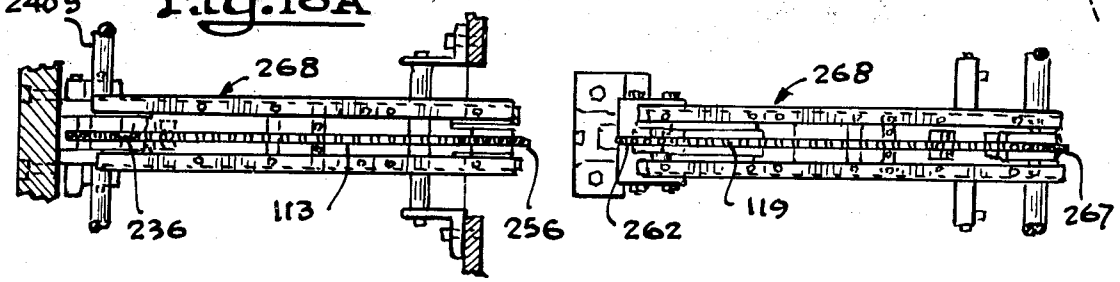
FIG. 16A is a plan view on the line 16A—16A of FIG. 16.

As shown in FIGS. 16A and 19, the sprockets for the lower carrier chains are similarly supported including support arms 268. The support arms 268, however, are stationarily fixed to brackets 268B, FIG. 16.

Drive sprocket 266 is carried on a shaft 266S, FIGS. 14 and 15, and this shaft is equipped at its end with a driven gear 269 in turn rotated by a driving gear 270 which as shown in FIG. 15 is meshed with a transmitting gear 271 in turn driven by a gear 272 fixed to shaft 267S which carries the driven sprocket 267. Thus, there is another gear train 266–270–271–272–273 for driving the carrier chains 118 and 119.

Gear 272 is meshed with a driving gear 273 which is part of the same gear train. Gear 273 is carried on a stub shaft 274 at the side of the machine, provided with a sprocket 276 driven by a chain 277 which in turn is driven by a sprocket 278, FIG. 30, on shaft 91 adjacent sprocket 246 and the same size as sprocket 246.

A shaft 279, FIG. 15, carries a large gear 280 meshed with and turned by a smaller gear 281 carried on shaft 91. Shaft 279 carries a sprocket 282 which drives a chain 283 connected to a sprocket (not shown) adjacent sprocket 276 on shaft 274, thereby to drive the delivery carrier 231.

Thus it will be seen that the upper and lower carrier chains in both the front set and the rear set derive power fron independently driven gear trains which in turn receive rotary motion from shaft 91, transmitted by chains and sprockets. The gear trains for the carrier chains are of identical ratios so that all carrier chains move at the same linear speed. Further, the support arms 260 and 263 which support the upper carriers 112 and 119 are joined by plates, and this enables both upper carrier chains to be adjusted simultaneously through the same adjusting increment as will now be described.

As shown in FIGS. 14 and 15 a bracket 285 including a pair of laterally spaced vertically extending arms 286 is pivotally supported on pins as 287, and pins 287 in turn are carried at the free ends of forwardly projecting arms 288 clamped to a support shaft 290 which extends between and is supported by the side frames of the machine. Bracket 285 is fastened to the right hand end of the support arm 263.

Support shaft 290, FIG. 16, has an oscillatable operating arm 292 clamped thereto, and when this arm is oscillated, shaft 290 is rocked whereby the support arms 286 will be raised or lowered as the case may be in which event gear 269 uses gear 270 as a track. Thus by comparing FIGS. 15 and 16, it will be noted that gear 269 is in a higher or more elevated position, FIG. 16, compared to the lower position in FIG. 15. This is equally true of gear 237 which uses gear 238 as a track, and the manner in which this precise and equal adjustment is accomplished will now be described.

Again referring to FIG. 14, a pair of arms 295 are clamped to a support shaft 296 which extends between and is supported by the side frames of the machine. The arms 295 extend forwardly and upwardly, FIG. 16, and are provided with pins 297 on which are journalled a pair of arms 298 which are part of a bracket 300. The bracket 300 is fastened to the left-hand or forward end of arm 260. Bracket 300 is provided with a bearing extension 300B which serves to support one end portion of shaft 266S. The opposite end portions of shafts 235S and 266S are supported for rotation at the ends of their respective arms 260 and 263.

Figure 17:
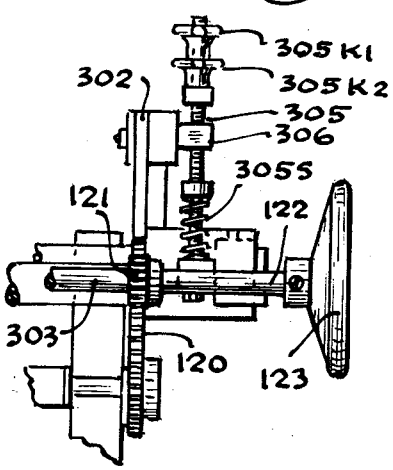
FIG. 17 is a fragmentary elevation of the hand wheel and gears for making the adjustment to the feed carriers.

A plate 302, FIGS. 15 and 17, presenting segment gear 120, is rotatably mounted on shaft 296. Normally, plate 302 is stationarily clamped to the adjacent side frame F of the machine by a washer-type clamp 302C, FIG. 13.

It will be recalled that pinion 121 is meshed with gear 120. The pinion 121 is fixed to a shaft 303, FIGS. 13 and 15, and this shaft carries the adjusting wheel 123, FIG. 1, which when turned, will be effective to turn plate 302 when the clamp 302C is released.

An arm 304, FIGS. 1 and 15, is clamped to the outboard end of shaft 296. Arm 304 at the free end thereof has an anchor block 304B, FIG. 15, having an opening through which is passed freely the lower end of a tie rod 305, FIG. 15. A nut is fixed to the lower end of rod 305. The upper end portion of the rod 305 extends, by a threaded connection, through a support block 306 at the upper end of the segment gear plate 302. Thus, when plate 302 is rocked, say clockwise, as viewed in FIG. 13, rod 305 is lifted. Rod 305, through nut 305N, turns arm 304, rocking shaft 296 in the same direction.

The adjusting plate 302 is joined to the arm 292, FIG. 16, by a rod 307. Thus when pinion 121 is turned, segment 120 is turned, plate 302 rocks on shaft 296 and transmits similar rocking motion to arm 292 which moves the connecting rod 307. The connections and centers are such that arms 286 and 298 are raised or lowered by the same increment.

Figure 13:
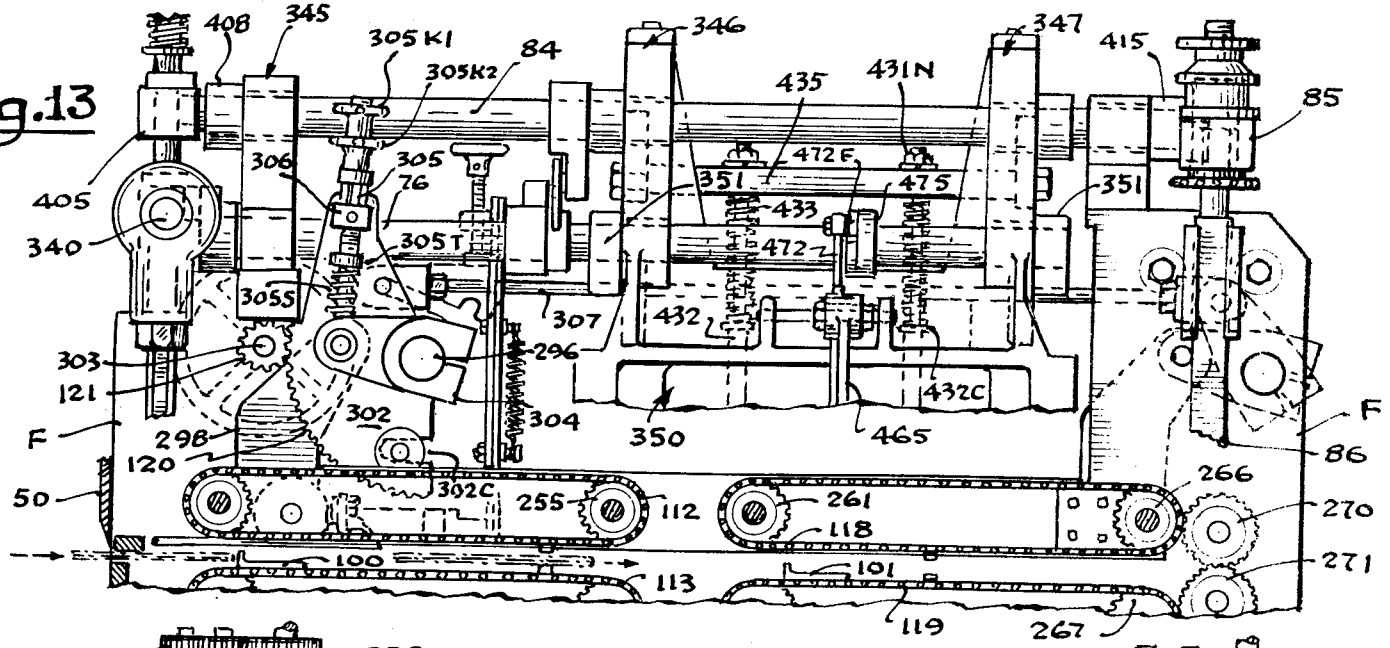
FIG. 13 is a fragmentary side elevation of the machine showing the two trimming stations.

The primary advantage to supporting the upper carrier chains in the manner described is that a jam of books between the knife stations may be easily and readily cleared by releasing clamp 302C, FIG. 13, and turning handle 123 to raise the supports for the upper carriers through the parallelogram linkage described. Moreover this same means enables the vertical spacing between the carrier lugs 111–112 and 116–117 to be adjusted to accomodate books of different thickness. In this connection adjustable stop means are provided to determine accurately the set spacing between the upper and lower carriers.

Referring to FIG. 16, shaft 296 to which the gear segment plate 302 is clamped is provided with an arm 308, and an adjusting screw 309 is threadedly mounted on the free end thereof. This screw at its upper end has a handle enabling the screw to be turned, and the opposite end of screw 309 bears on a fixed abutment 309A.

When shaft 296 is turned clockwise incidental to raising the upper carrier supports, the free end of screw 309 is disengaged from the abutment 309A, but when the carrier supports are returned screw 309 will engage the abutment 309A to maintain the fixed position separating the carriers by the required distance.

Nonetheless, arm 304, FIG. 13, is yieldable, which is to say that the connection between arm 304 and plate 302 is yieldable. This is accomplished by a known lost motion connection including a spring 305S, FIG. 13, which surrounds a portion of rod 305. The lower end of the spring gears on the top of the abutment 304B on arm 304 in which the lower end of the rod 305 is slidably fitted. The upper end of the spring bears on a stop 305T carried by rod 305. Rod 305 is threadedly mounted in the block 306 and may be adjusted therein by lock knobs 305K1 and 305K2 to vary the spring pressure. If a jam is encountered, the carriers may tend to be lifted and this is manifest in clockwise motion of arm 304, compressing spring 305S.

The books to be trimmed by the side knives are advanced by the carrier lugs 110 and 111 to a set of pusher fingers 317, FIG. 18, carried on a rock shaft 317S to which is affixed an operating lever 317L adapted to be oscillated by a reciprocable rod 318. Thus, one end of the rock 318 is pivotally connected to the lower end of the lever 317L and the opposite end of the rod 318 is pivotally connected to the upper end of one arm 319A of a bell crank lever system 319. The opposite arm 319B of the bell crank is tensioned by a spring 320, urging a follower 321 against a cam 322 on shaft 60.

As shown in FIG. 18 the high part of cam 322 is presented to the follower 321, positioning the pusher fingers 317 in their rearwardmost position, ready to deliver a book, advanced thereto by the carrier lugs 110 and 111, to the stops 101 at the side knife trimming station. As the high part or lobe of cam 322 passes off the follower 321, spring 320 is effective to rock the bell crank system 319 counterclockwise as viewed in FIG. 18, pulling rod 318 rearward, resulting in forward or clockwise motion of the pusher fingers 317 which deliver the book to the stops 101. From this it will be seen why it is important to be able to adjust the stops 100 and 101.

As was mentioned above, the stops 101 in their operation are essentially similar to the stop elements 100. Thus the rear stops 101 are pivotally supported in the manner of the stops 101 and are associated with a guide rail 194A similar in all respects to the rail 194. Additionally the rail 194A is supported by a pedestal 330, FIG. 18, in turn joined to a vertical slide 331 normally biased upwardly by springs 332S.

The slide 331 is provided with means which define a recess 331R, and a roller 332 is disposed therein. The roller 332 is carried at the forward end of one arm of a bell crank lever 333 rotatably mounted on a rock shaft 334. The other arm of the bell crank, 335, is provided at its free end with a roller 335R which follows a cam 336 on cam shaft 91. Thus cam 336 is effective to raise and lower rail 194R to interpose and retract the stops 101 relative to the path of the book being delivered to the side knives by the pushers 317.

OPERATION OF THE KNIVES

As described above, the front knife is carried by a massive head 51, FIG. 9, and the two sides knives 70 and 71 are carried by heads 73 and 74, FIGS. 24. Shaft 60, FIGS. 9 and 31, carries the eccentrics 58 and 59, and these eccentrics are effective through the usually associated races 58R and 59R to reciprocate a pair of vertical, front knife operating arms 55 and 56 extending upwardly therefrom. The upper ends of the front knife operating arms are pivotally connected to studs 340 projecting outwardly from opposite sides of the head 51 for the front knife as best shown in FIG. 9. The manner in which the knife head 51 is guided will be described below. The manner in which the front knife is constructed constitutes no part of the present invention and in fact operation of the front knife is standard.

Figure 27:
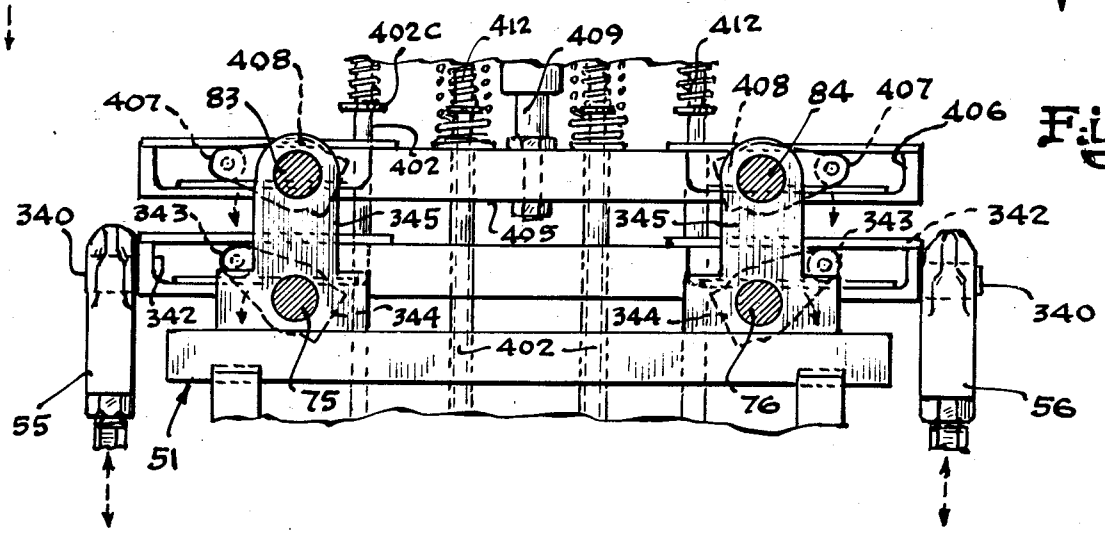
FIG. 27 is a sectional view on the line 27—27 of FIG. 26.

The rear side or face of the knife head 51, at the top thereof, is provided with means affording a pair of horozontally elongated recesses 342, and rollers 343 are fitted therein, FIGS. 9 and 27. The rollers 343 are journalled at the free ends of arms 344, and the arms 344 are clamped to the free front ends of the longitudinally extending side knife operating shafts 75 and 76. Each of the shafts 75 and 76, FIGS. 1 and 2, is supported for rocking motion in a respective set of three bearings presented by upright posts 345, 346, and 347 at opposite sides of the machine. These same posts present bearings which rotatably support the shafts 83 and 84 for controlling certain ones of the clamps.

When the front knife head 51 is driven downward by rods 55 and 56, FIG. 27, arms 344 are rocked at the same time, turning rock shafts 75 and 76. This downward stroke of the front knife head is accompanied by upward movement of the heads 73 and 74 which support the side knives, and on reverse or return movement of the front knife, the side knives are dropped to perform their cutting action. It may be noted that the cutting edge as 70E, FIG. 25, of each side knife is angled just as the cutting edge of the front knife is angled, and that each side knife edge as 70E, FIG. 25A, cooperates with a fixed cutting edge presented by a block 70L in the manner of the front knife.

Motion is transmitted from shafts 75 and 76 to the side knife heads in a manner now to be described.

The heads of the side knives are guided at their side edges for motion in vertical ways or slots presented by a stationary knife holder as 350, FIG. 13. A pair of arms as 351 are clamped to the respective rock shafts as 76, FIGS. 13 and 24, and the inner free end of each arm is pivotally connected to a connector link 352 in turn pivotally connected to a pin or stud 353 at the upper end of the vertically guided side knife head. Thus when the rock shafts 75 and 76, FIG. 27, are rocked, the side knives are reciprocated vertically in an upward stroke or a downward stroke as the case may be.

OPERATION OF THE CLAMPS

As mentioned above, certain of the clamps for holding the books while being trimmed are operated through the rock shafts 83 and 84, FIG. 27. There are a pair of presser pads for flattening the backbone or fold of the book at the time of trimming the front edge, and there is a bar engageable with the front margin of the book at the time of trimming the front edge. The presser pads for the backbone will first be described.

Figure 10:
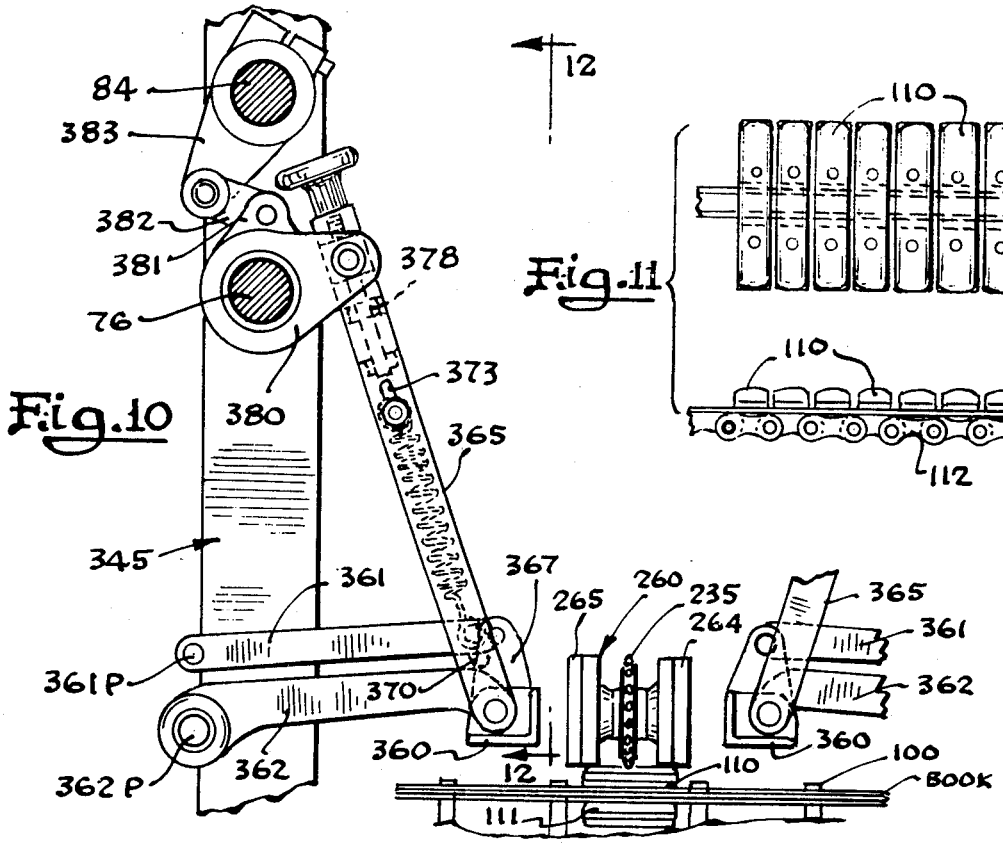
FIG. 10 is a fragmentary elevation, partly in section, showing the clamps and related parts at the first knife station of the machine.
Figure 11:
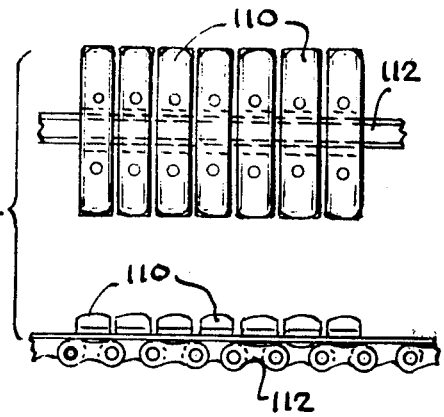
FIG. 11 is a combined view showing a fragment of one of the feed bands both in plan view and in elevation.
Figure 12:
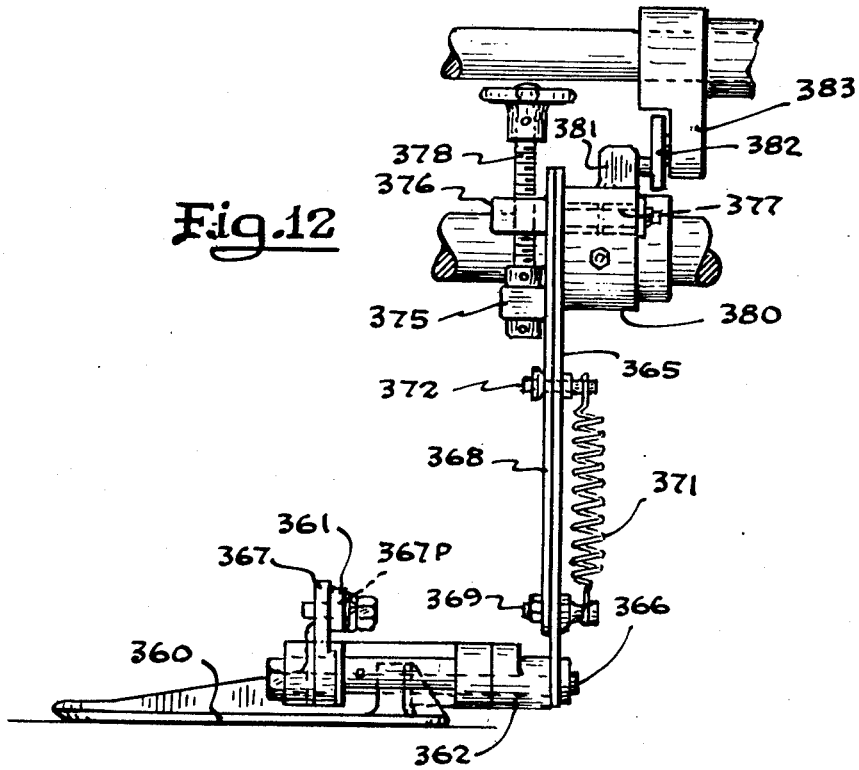
FIG. 12 is a fragmentary elevational view showing the presser pad and related parts used to flatten the backbone of the book at the first trimming station.

Referring to FIGS. 10 and 12, a pair of elongated presser pads or shoes 360 are presented at the first knife station and these shoes are supported for up and down motion, effective in the down position to flatten the back of the book. A pair of support arms 361 and 362 project inward from pivot pins 361P and 362P supported by the side frame of the machine. The inner ends of these arms pivotally support the presser shoe in the manner shown in FIGS. 10 and 12.

The flatteners 360 are reciprocable by means including a flat drive bar 365 which at its lower end is pivotally connected to a pin 366 to which the right hand end of arm 362 is pivotally connected. It may be observed further that the presser pad or shoe has a lug 367 projecting upward therefrom, and this lug supports a pivot pin 367P to which the right hand end of arm 361 is connected.

A shorter flat bar 368 is juxtaposed on bar 365. Bar 368 carries a stud 369 which is extended through an elongated slot 370 in bar 365. A spring 371 is anchored at its lower end to stud 369 and at its upper end the spring is anchored to a stud 372 which is carried by bar 365, noting that the stud 372 projects through an elongated slot 373 in the short bar 368, FIG. 10. Because of the stud-in-slot, spring tensioned arrangement, bar 365 is adapted to slide relative to bar 368.

The short bar 368 has a lug 375 secured thereto. A lug 376 has a journal pin 377 projecting through an aperture in arm 368, and the pin is journalled in a bearing carried by a short arm 380 pivotally mounted on the side knife operating shaft 76. A screw 378 is threadedly mounted in lug 376, and the end of the screw is joined to lug 375 as shown in FIG. 12. It will be recognized that by turning screw 378, the index position of pad 360 may be varied.

An ear 381 on arm 380 serves to support a pin to which is pivotally connected one end of a connector link 382, and the opposite end of the connector link 382 is pivotally connected to a pin on arm 383 clamped to the rock shaft 84.

Thus when rock shaft 84 is turned counterclockwise as viewed in FIG. 10, arm 380 is turned clockwise, and this motion is transmitted to the drive bar 365 through bar 368 and spring 371. In the event of a jam of some kind, the drive bar 365 will yield as permitted by the tensioning spring 371 and the stud-in-slot connections.

The arrangement thus described, FIGS. 10 and 12, is repeated for the right hand backbone flattener 360.

There is an additional clamp at the front knife station represented by a horizontal bar 400, FIG. 9, adapted to apply pressure to the front margin of the book during the time that the knife edge 50E is operative to trim the front edge of the book. The clamp bar 400 is carried by four rods 401, the clamp bar 400 being fixed to the lower ends of the rods 401. The rods 401 extend upwardly through guide sleeves 402. The sleeves 402 also extend through a clamp bar drive head 405 and terminate in colors 402C.

The drive bar 405 is provided with slots 406 in the rear face thereof. Rollers 407 are mounted in the slots 406, and these rollers are pivotally supported at the outboard ends of arms 408 which are clamped to the rock shafts 83 and 84. Thus when the rock shafts 83 and 84 are turned the arms 408 are turned therewith and serve to transmit vertical motion to the clamp drive head 405.

As shown in FIGS. 9 and 27, a large tie tod 409 is fixedly secured to the clamp bar drive head 405 and extends upwardly therefrom. The intermediate portion of the rod 409 is threadedly mounted on an adjusting boss 410 which is fixed to and depends from a cross head 411. The upper ends of the rods 401 extend through apertures in the cross head 411 and large nuts 401N in effect connect the rods 401 to the cross head 411 for movement therewith. Coil springs 412 concentrically surround portions of the rods 401 between the drive head 405 and the cross head 411. The springs 412 at their upper ends react at the underside of the cross head 411 and at their lower ends bear on the collars 402C.

The tie rod has a knob or handle 409H at the upper end thereof enabling the tie rod to be turned in the boss 410, thereby to adjust the position of the front knife clamp relative to the side knife clamp. It will be recognized that when the clamp 400 engages a book, the springs 412 allow the cross head 411 to float.

The rock shafts 83 and 84 as already mentioned are supported in bearings in the posts 345, 346 and 247 at the sides of the machine. The ends of the rock shafts 83 and 84 opposite the arms 408 are provided with similar arms 415, and the arms 415, clamped to the rock shaft 84, have rollers 416, FIG. 26, at the free ends thereof fitted in the slots in the drive bar 85. The drive head 85 for the clamp 400 extends laterally of the machine, and the arrangement thus described is duplicated at the opposite side of the machine with respect to rock shaft 83 as will be apparent in FIG. 31.

It has already been mentioned that the drive head 85 is operated by a pair of vertically extending arms or bars 86. Drive bars 86 are guided by sets of guide rollers as 417 at the side of the machine, FIGS. 26 and 31, and are operated by a pair of levers 420 in the manner apparent from FIGS. 15 and 31. The levers are secured to opposite ends of the rock shaft 334, and at their free ends are provided with rollers 421R, FIG. 15, engaging abutments on the arms 86 to operate the same.

As already mentioned, the operation of the clamp drive head 85 is under control of a box cam 90, and in this connection it will be observed that an operating lever 421, FIGS. 15 and 31, is secured at one end to rock shaft 334. At its opposite end, lever 421 is provided with a follower 421F which travels in a cam slot in the box cam 90. Thus, the box cam 90 is responsible for oscillating lever 421 and motion is transmitted through rock shaft 334 to the levers 420 which operate the drive arms 86 to raise and lower the cross head 85, thereby operating the book clamp bar 400.

In addition there are clamps 81 and 82 adjacent each side knife as already mentioned, FIG. 24, and these clamps are supported at the lower ends of rods 431 extended through guide sleeves 432, FIG. 25, which in turn extend upward through each knife head as 74. The upper ends of the guide sleeves are provided with collars 432C. Coil springs 433, FIG. 25, surround the rods 431 in the portions thereof which extend upward above the knife head. The lower ends of the springs 433 bear on the tops of the collars 432C, and the upper ends thereof react at the underside of a reciprocal cross head 435. The rods 431 are secured to the cross head 435 for movement therewith by nuts 431N. The arrangement is of course duplicated for each of the side clamps 81 and 82.

Each cross head 435 includes pins 436 at the opposite ends thereof, FIG. 25, and connector links 437 are pivotally mounted thereon. The opposite ends of the connector links are pivotally mounted on pins 438, FIG. 24, carried at the inner ends of arms 440 which are clamped to the rock shafts as 83 and 84.

Thus when the rock shafts as 83 and 84 are rocked the clamps 81 and 82 associated therewith are rocked to engage the margins of the book adjacent the cutting lines of the side knives.

Figure 26:
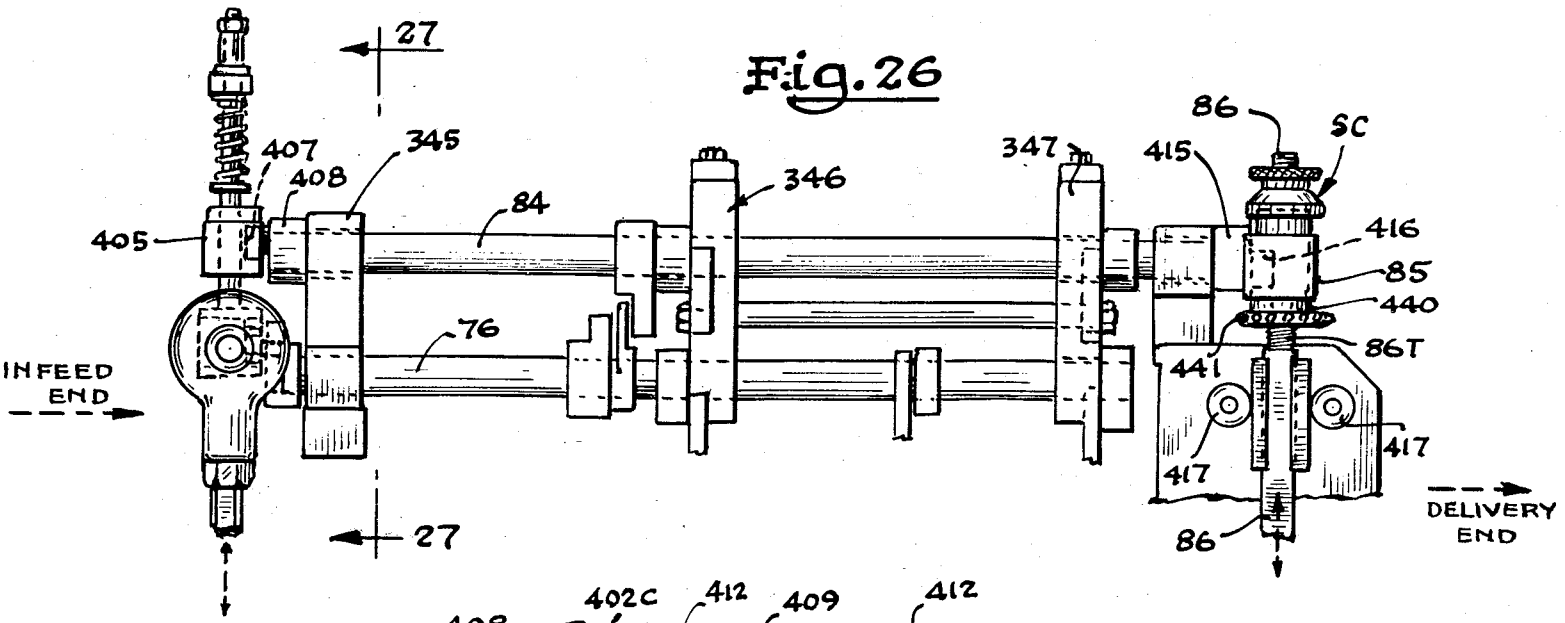
FIG. 26 is a side elevation showing the rock shafts associated with the knife heads and the clamp heads.

Provision is made for adjusting the effective stroke of the clamp drive head 85, FIGS. 13 and 26, and in this connection it should first be noted that the upper ends of the drive bars 86 are threaded at 86T, FIGS. 26 and 29. A stop nut 440 is threaded onto the threaded portion of the drive bar 86, and this nut has a sprocket 441 integral therewith. The arrangement thus far described is repeated for each of the drive bars 86.

The cross head 85 is provided with a sleeve 443, FIG. 29, which surrounds a concentric extension of the drive bar 86, and appropriate spacers and clamp nut assemblies SC, FIGS. 26 and 29, are used to tighten the cross head 85 against the stop nuts 440.

The cross head or drive head 85 supports a knob 450, FIG. 29, to which is secured a shaft 451. The shaft 451 at its opposite or lower end carries a sprocket 453, FIG. 28, around which is trained a chain 455. The chain 455 is also trained around the sprockets 441 and a pair of tensioning sprockets 456. The arrangement and thread hands are such that upon turning the knob 450, the sprockets 441 associated with the nuts 440 are turned, thereby to simultaneously raise or lower the cross head 85 by an equal amount at each end. This varies the effective stroke imparted by the cross head 85 to the clamp operating arms 415.

Prior to making the head and foot cuts with the side knives 70 and 71, and prior to the head and foot margins being immobilized by the side clamp bars 81 and 82 (all moving clamps force the books against the stationary anvil represented by plate 142) the side edges of the books are simultaneously jogged to assure a straight cut. In this connection attention is directed to FIGS. 24 and 25 showing a pair of vertically extending side jogger support arms 465 pivotally mounted on a stationary shaft 466 supported by a pair of ears 467 at the upper end of each side knife holder 350. The arrangement now being described is repeated for each of the side knives as will be apparent from the drawing.

The lower end of each side jogger support arm 465 carries an adjustable finger 469 extending inwardly as will be apparent in FIG. 24, and the inner end of the finger 469 has a flat jogger blade 470 attached thereto. Each jogger blade 470 extends accurately in a plate parallel to the path of movement of the book into and from the side knife trimming station.

The jogger support fingers 469 are threadedly supported at the lower end of each support arm 465 and are adjustable through a knob 469K which is part of the support finger 469.

An operating lever 472, FIG. 24, integral with arm 465 extends upwardly therefrom and is normally biased in an inward direction by a spring (not shown) effective to present a follower 472F, FIGS. 13 and 25, to an oscillating cam 475 mounted on the corresponding rock shafts 75 and 76 as will be apparent from FIG. 25B. The cam 475 has two pockets 475A and 475B, FIG. 25B, for receiving the follower 472F, the pockets being separated by a lobe or high part, whereby the jogger support arm 465 is operated each time the knife control rock shaft is oscillated. Consequently, both of the flat jogger blades 470 are presented to the head and foot edges of the book to align these edges parallel with the cutting edges of the side knives.

TIMING, FIG. 32

Figure 32:
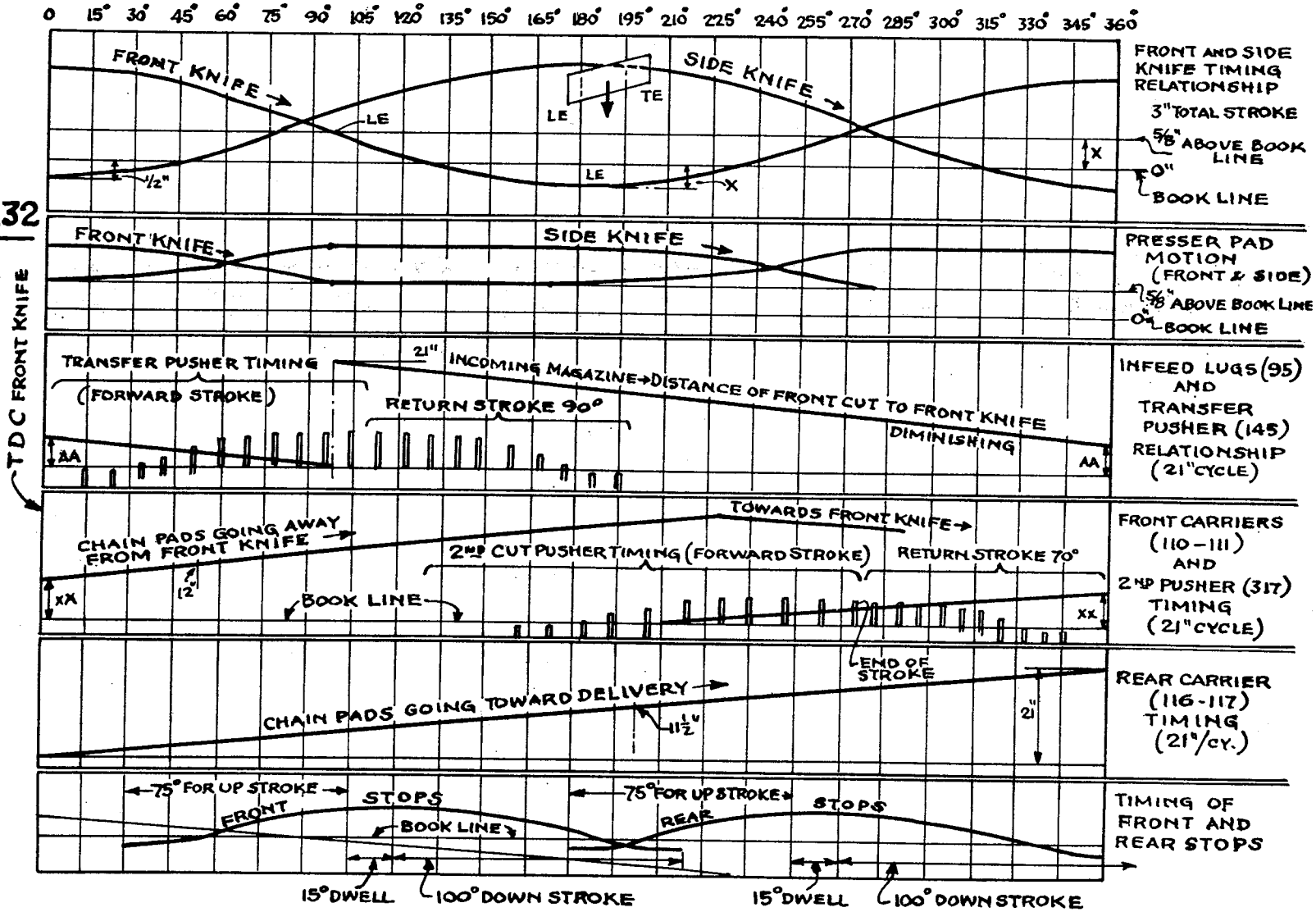
FIG. 32 is a timing chart showing phases of operation.

The machine is of course cyclically operated, and a cycle of operation is defined as a 360° cycle which includes the downward stroke of a knife and its return, FIG. 32. The "book line" FIG. 32, is defined as the upper surface of the plate 142 on which the book reposes at each trimming station.

In connection with the operation of the knives it should be borne in mind that each knife edge is slanted, and in FIG. 32 it will be assumed that the book is five-eighths inch thick. Thus the lower or leading corner of the slanted front knife edge 50E commences to cut through the book (five-eighths inch above book line) after about 97½° of the machine cycle, and the cut is finished after 180° characterizing the upper or trailing corner of the front knife attaining the book line position. The lower corner of the front knife on the upstroke clears the book after about 262½° of the machine cycle, and in the meantime the side knives have been operating in the reverse manner, thereby balancing the moving masses of the machine represented by the knife heads.

The cyclical operation of the front presser pad or block 400 and that of the presser pads 81 and 82 for the side knives is next set forth in FIG. 32, and in this connection it will be noted that the presser pad 400 engages the top of the book concurrently with the commencement of the front cut. The clamped condition for the book at the front knife station is held until about 170° of machine cycle, whereafter the pressure of the front pad is relieved well in advance of the front knife clearing the top of the book during the front knife return stroke. Thus by separating the clamp drive (rock shafts 83 and 84) from the knife drive (rock shafts 75 and 76), it is possible to correlate actions as desired.

When the front clamp 400 (and 360 as well) is released, this means that the front carrier lugs or bars 110 and 111 may pick up the book and advance it toward the book stops 101. This occurs at the 210° phase of the machine cycle, and at this time the front stops are retracted below the book line.

Therefore after about 210° of machine cycle the carrier bars 110 and 111, in their motion away from the front knife, advance the book toward the pushers 317. It must now be borne in mind that as the book moves away from the first knife station, the front knife is being raised and conditions are being established for the next cycle of operation. After about 195° of the next or second cycle, the carrier pads 110 and 111 have advanced the book well beyond the first knife, say 20-5/16 inches, FIG. 32, to the pushers 317 which now push the book to the rear stops 101. The book to be trimmed by the side knives engages the rear stops at about the 275° phase of the second machine cycle, just a few degrees prior to the side knives and the side clamps becoming effective.

At the attainment of about 97½° of a machine cycle, a new book on the in-feed chains is about 21 inches from the front knife, FIG. 32, and is advanced forward by the in-feed lugs 95 throughout the remainder of the cycle. At about 35° in the next cycle, this book is picked up by the pusher fingers 145 which advance the book to the front stops 100. The book is against the front stops at about 95°, just a few degrees prior to the front knife making its penetration.

SUMMARY

It will be seen from the foregoing that under the present invention the front knife is undergoing its downstroke when the side knives are in the course of upward movement at their respective knife stations, and vice versa. In accomplishing this, the force applying means for operating the knives, represented by the eccentrics 58 and 59, is connected directly to the front knife head through connecting rods 55 and 56, so that a stroke of the latter in one direction is translated into motion in the opposite direction for the side knives by the arrangement of the rock shafts 75 and 76 and the associated lugs or arms.

In like fashion, the box cam 90 is responsible for operating the connecting rods 86, applying force to the clamp operated head 85, oscillating the rock shafts 83 and 84 and the associated arms connected to the clamps. Just as the side knives are 180° out of phase with respect to the front knife, so the clamps 81 and 82 are 180° out of phase with respect to the front clamp 400, and again this is accomplished by harnessing a set of rock shafts appropriately.

The books or stacked sheets to be trimmed are advanced sequentially to the first knife station along the guide plate 141 by in-feed lugs 95 carried by the endless chains 96. The trap door means 143 represents an extension of the table or plate 141, being located at the point where the chains 96 reverse their travel from a direction toward the front knife station to a direction away from the front knife. At this point of change the reciprocal pusher fingers 145 are advanced forwardly to engage the trailing edge of the book and force it firmly against the front stops 100, which have been interposed in the path of travel of the book along the guide plate or table 142, whereafter the pusher fingers are retracted for the next forward feeding cycle. The trap doors 143 are lowered when the first cut is made, thereby to drop the chips or trims. This entails timed operation of the pusher fingers 145 and the trap door 143, and such timing is conveniently achieved by means of the cams 160 and 161.

Following the trimming operation at the front knife station the stops 100 are lowered, the front clamp 400 is released along with the backbone clamps 360, and the book is picked up by the carriers 110 and 111 which advance or feed the book to a second set of pusher fingers 317. These pusher fingers are also timed in their operation by a cam and are effective to advance the book delivered thereto against the stops 101, which are interposed and retracted in a sequence timed by a cam (336) just as timed operation of the front stops is under control of a cam (227).

The two sets of stops, 100 and 101, can be adjusted in a longitudinal direction parallel to the path of movement of the books simultaneously by means of the rack 105.

The carrier chains 112–113 and 118–119 are also of endless form. The upper carrier chains 112 and 118 are individually supported on their gear driven sprocket shafts for simultaneous adjustment toward and away from the opposed, lower carrier chains 113 and 119. This is accomplished through a parallelogram linkage, the supports being so arranged as to use gears 238 and 270 as an accurate index or track. Thus as gear 237 is advanced or retracted by any fraction of a tooth, gear 269 moves the same fraction.

We claim:

1. In a machine for trimming stacked sheets such as signatures or the like fed through the machine in sets of stacks one after another to be trimmed first at one knife station and then at a second knife station, and in which the dimensions of the stacks including height may vary from one machine run to the next: feed means including a set of opposed, vertically spaced feed bands for advancing a stack of trimmed sheets from the first knife station toward the second knife station, other feed means including a set of opposed vertically spaced feed bands for clearing a stack of trimmed sheets from the second knife station, individual supports for the upper feed bands in the two sets of feed bands, each of said individual supports having a rotary shaft rotation of which is accompanied by raising or lowering of the related support, means joining the shafts so that an increment of rotation in one shaft is accompanied by a substantially equal increment of rotation in the other shaft whereby the two supports may be adjusted simultaneously by an equal amount, and manually operable gear means for imparting an increment of rotation to one of the shafts.

2. A machine according to claim 1 in which the adjusting means include: a parallelogram linkage joining the supports for the upper feed bands whereby adjustment imparted to one support is transmitted by an equal degree to the other support, and gear means operable by an exposed handle on the machine to impart adjustment to said one support.

3. A machine according to claim 1 in which the feed bands are endless chains on sprockets supported by shafts, said shafts including drive shafts provided with gears driven by drive gears having fixed axes of rotation, and the gears on th drive shafts being carried by the supports for the feed bands whereby the supports for the feed bands during adjustment use the teeth of the drive gears as an index.

4. A machine according to claim 1 having stops positionable at each station to arrest a stack of sheets for trimming, supports for said stops, and means joining the stops for simultaneous adjustment fore and aft to accommodate the stops to stacks of varying length.

5. A machine according to claim 4 wherein the means joining the stops is a rack, and a pinion rotatable by an external handle for shifting the rack.

* * * * *